US009241379B2

(12) United States Patent
Shin et al.

(10) Patent No.: US 9,241,379 B2
(45) Date of Patent: Jan. 19, 2016

(54) METHOD OF DIMMING A LIGHT SOURCE AND DISPLAY APPARATUS FOR PERFORMING THE METHOD

(75) Inventors: Ho-Sik Shin, Anyang-si (KR); Gi-Cherl Kim, Asan-si (KR); Se-Ki Park, Asan-si (KR); Seok-Won Kang, Gwangju-si (KR); Hee-Kwang Song, Anyang-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 736 days.

(21) Appl. No.: 12/769,852

(22) Filed: Apr. 29, 2010

(65) Prior Publication Data

US 2010/0309194 A1 Dec. 9, 2010

(30) Foreign Application Priority Data

Jun. 8, 2009 (KR) ..... 2009-0050241

(51) Int. Cl.
*G09G 3/34* (2006.01)
*H05B 33/08* (2006.01)

(52) U.S. Cl.
CPC ..... *H05B 33/0818* (2013.01); *G09G 3/3426* (2013.01); *H05B 33/086* (2013.01); *G09G 2320/0233* (2013.01); *G09G 2320/0238* (2013.01)

(58) Field of Classification Search
CPC ..... G09G 3/342; G09G 3/3426; G09G 2320/0233; G09G 2320/0238; H05B 33/0818
USPC ..... 345/102
See application file for complete search history.

(56) References Cited

U.S. PATENT DOCUMENTS

| | | | | |
|---|---|---|---|---|
| 2007/0285379 | A1* | 12/2007 | Jung et al. | 345/102 |
| 2008/0068331 | A1* | 3/2008 | Sugawara et al. | 345/102 |
| 2009/0002310 | A1* | 1/2009 | Kawaguchi et al. | 345/102 |
| 2009/0033611 | A1* | 2/2009 | Mizumaki | 345/102 |
| 2010/0013847 | A1* | 1/2010 | Shin | 345/589 |
| 2010/0053064 | A1* | 3/2010 | Hamada | 345/102 |
| 2010/0073276 | A1* | 3/2010 | Koike et al. | 345/102 |

FOREIGN PATENT DOCUMENTS

| | | | |
|---|---|---|---|
| CN | 101063773 | A | 10/2007 |
| JP | 2000321571 | A | 11/2000 |
| JP | 2000321993 | A | 11/2000 |
| JP | 2002099250 | A | 4/2002 |
| JP | 2007052105 | A | 3/2007 |
| JP | 2008015430 | A | 1/2008 |
| KR | 1020050112905 | A | 12/2005 |

(Continued)

*Primary Examiner* — John Kirkpatrick
(74) *Attorney, Agent, or Firm* — Cantor Colburn LLP

(57) ABSTRACT

A method of dimming a light source module including a light guide plate, a first light emitting module including first to k-th light source blocks, wherein the first light emitting module is disposed on a first edge of the light guide plate, and a second light emitting module including first to m-th light source blocks, the second light emitting module being disposed on a second edge of the light guide plate, the second edge disposed opposite the first, the method including; generating a first group of driving signals and a second group of driving signals based on an image signal and driving the first to k-th light source blocks using the first group of the driving signals during a first period in a reference period and driving the first to m-th light source blocks using the second group of driving signals during a second period in the reference period.

19 Claims, 19 Drawing Sheets

(56) References Cited

FOREIGN PATENT DOCUMENTS

| | | | | | |
|---|---|---|---|---|---|
| KR | 1020060089375 | A | | 8/2006 | |
| KR | 1020060109847 | A | | 10/2006 | |
| KR | 1020060125321 | A | | 12/2006 | |
| KR | 1020070002313 | A | | 1/2007 | |
| KR | 1020080000825 | A | | 1/2008 | |
| KR | 1020080002301 | A | | 1/2008 | |
| KR | 1020080050043 | A | | 6/2008 | |
| KR | 1020080070214 | A | | 7/2008 | |
| KR | 1020080078210 | A | | 8/2008 | |
| WO | WO-2008/065765 | | * | 6/2008 | ..... H05B 37/02 |

* cited by examiner

METHOD OF DIMMING A LIGHT SOURCE AND DISPLAY APPARATUS FOR PERFORMING THE METHOD

This application claims priority to Korean Patent Application No. 2009-50241, filed on Jun. 8, 2009, and all the benefits accruing therefrom under 35 U.S.C. §119, the content of which in its entirety is herein incorporated by reference.

BACKGROUND OF THE INVENTION

1. Field of the Invention

Exemplary embodiments of the present invention relate to a method of dimming a light source and a display apparatus for performing the method. More particularly, exemplary embodiments of the present invention relate to a method of dimming a light source capable of improving display quality and a display apparatus for performing the method.

2. Description of the Related Art

In general, a typical liquid crystal display ("LCD") apparatus includes an LCD panel displaying an image using light transmittance of liquid crystals and a backlight assembly disposed under the LCD panel to provide light to the LCD panel.

The typical LCD panel includes an array substrate having a plurality of pixel electrodes and a plurality of thin film transistors ("TFTs") electrically connected to the plurality of pixel electrodes, a color filter substrate having a common electrode and a plurality of color filters and a liquid crystal layer disposed between the array substrate and the color filter substrate.

Recently, in order to reduce power consumption of an LCD apparatus, dimming technology in which the backlight assembly is divided into a plurality of light emitting blocks and luminance of the light emitting blocks is individually controlled, has been developed.

In the recently developed dimming technology, a display of the LCD panel is analyzed and at least some of the light emitting blocks, may have the light transmittance thereof compensated according to the luminance of an image to be displayed on the LCD panel, so that the power consumption of the backlight assembly may be reduced and a contrast ratio may be increased.

In general, one-dimensional dimming technology may be used in the LCD panel which includes light sources disposed at least one of upper, lower, left and right edges of the LCD panel. The one-dimensional dimming technology includes small numbers of the light emitting blocks so that driving logic may be simplified. However, the power consumption may be increased and the display quality such as the contrast ratio may be decreased when bright images such as subtitles are displayed on several light emitting blocks.

BRIEF SUMMARY OF THE INVENTION

Exemplary embodiments of the present invention provide a method of dimming a light source for improving display quality in an edge type light source structure. Exemplary embodiments of the present invention also provide a display apparatus for performing the method.

According to an exemplary embodiment of the present invention, a method of dimming a light source module, the light source module including a light guide plate, a first light emitting module including first to k-th light source blocks, wherein the first light emitting module is disposed at a first edge of the light guide plate, and a second light emitting module including first to m-th light source blocks, wherein the second light emitting module is disposed at a second edge of the light guide plate, the second edge being disposed substantially opposite to the first edge, wherein k and m are natural numbers, the method including; generating a first group of first to k-th driving signals and a second group of first to m-th driving signals, based on an image signal, and driving the first to k-th light source blocks of the first light emitting module using the first group of the first to k-th driving signals during a first period in a reference period, and driving the first to m-th light source blocks of the second light emitting module using the second group of the first to m-th driving signals during a second period in the reference period.

According to another exemplary embodiment of the present invention, a display apparatus includes; a display panel, a light source module including a first light emitting module including first to k-th light source blocks and disposed at a first edge of the display panel, and a second light emitting module including first to m-th light source blocks and disposed at a second edge of the display panel, the second edge being disposed substantially opposite to the first edge, and a light source driver generating which generates a first group of first to k-th driving signals to drive the first to k-th light source blocks of the first light emitting module during a first period of a reference period, and generating which generates a second group of first to m-th driving signals to drive the first to m-th light source blocks of the second light emitting module during a second period of the reference period, wherein k and m are natural numbers.

According to exemplary embodiments of the present invention, a reference period is divided into two periods, which are a first period and a second period. A first group of driving signals is provided to a first group of light source blocks during the first period and a second group of driving signals is provided to a second group of light source blocks during the second period. Therefore, the display quality of the display apparatus may be improved.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION OF THE INVENTION

Figure 1:
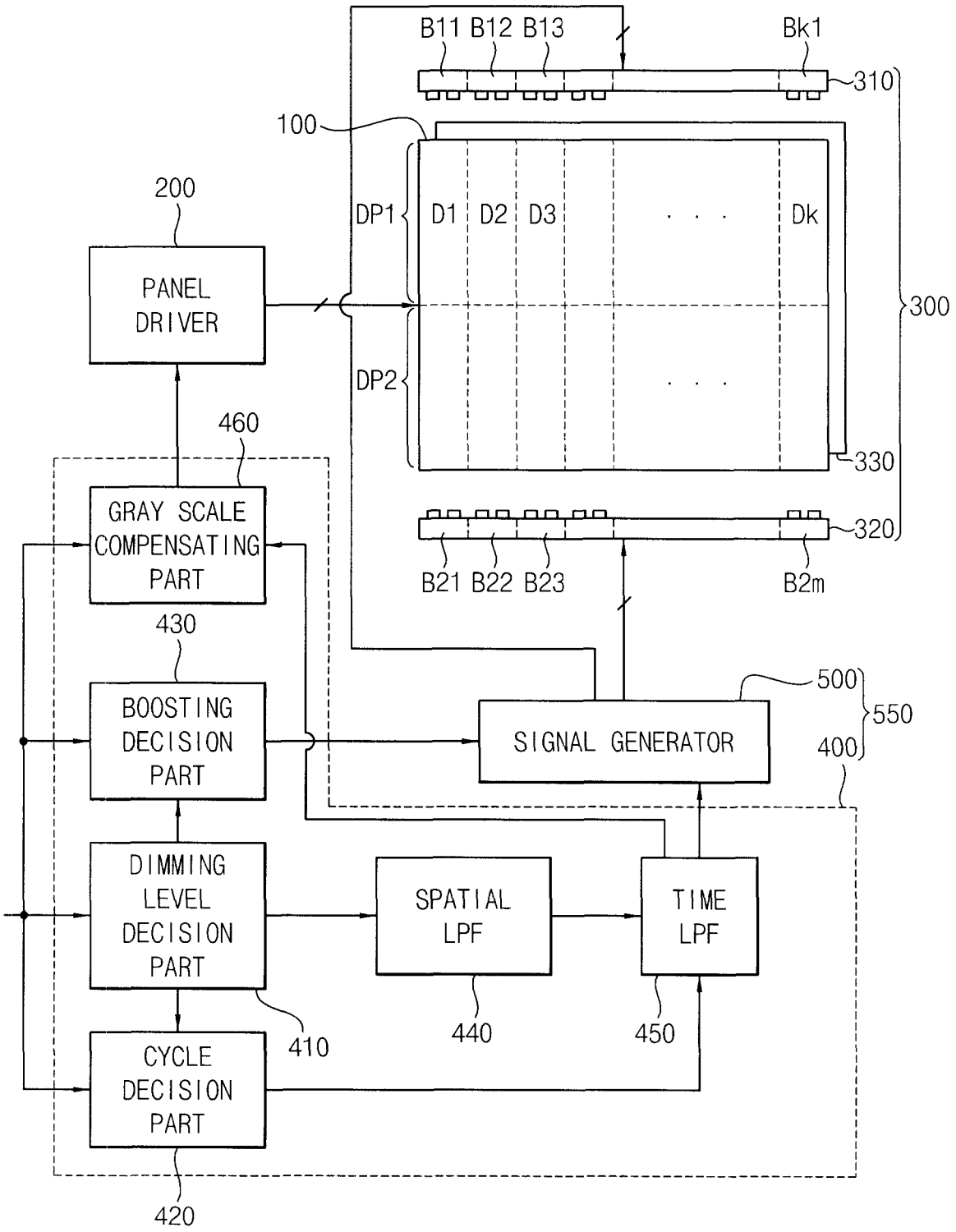
FIG. 1 is a block diagram illustrating an exemplary embodiment of a display apparatus according to the present invention.

The present invention now will be described more fully hereinafter with reference to the accompanying drawings, in which exemplary embodiments of the present invention are shown. The present invention may, however, be embodied in many different forms and should not be construed as limited to the exemplary embodiments set fourth herein. Rather, these exemplary embodiments are provided so that this disclosure will be thorough and complete, and will fully convey the scope of the present invention to those skilled in the art. Like reference numerals refer to like elements throughout.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the present invention will be explained in detail with reference to the accompanying drawings.

Figure 2:
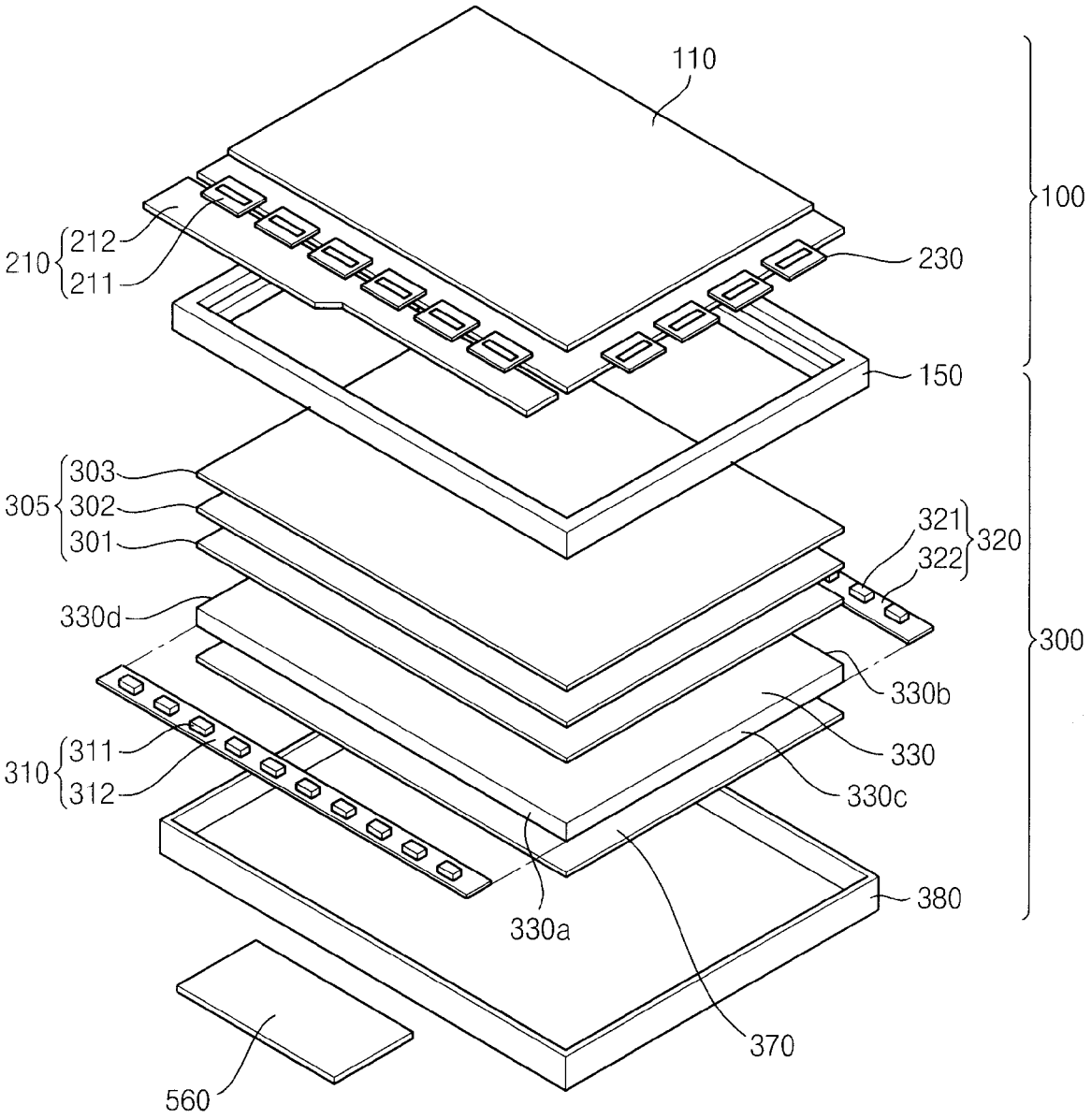
FIG. 2 is an exploded perspective view illustrating the exemplary embodiment of a display apparatus of FIG. 1.

FIG. 1 is a block diagram illustrating an exemplary embodiment of a display apparatus according to the present invention and FIG. 2 is an exploded perspective view illustrating the display apparatus of FIG. 1.

Referring to FIGS. 1 and 2, the present exemplary embodiment of a display apparatus includes a display panel 110, a panel driver 200, a light source module 300 and a light source driver 550.

The display panel 110 includes a plurality of pixels for displaying an image. For example, in one exemplary embodiment the display panel 110 includes M×N pixels, wherein M and N are natural numbers. Each of the pixels includes a switching element which is connected to a gate line, a data line, a liquid crystal capacitor and a storage capacitor. Exemplary embodiments include configurations wherein the storage capacitor may be omitted.

The panel driver 200 drives the display panel 110. For example, in one exemplary embodiment the panel driver 200 includes a timing controller (not shown) which controls driving timing of the display panel 110, a data driver 210 which inverts a compensated grayscale provided from a dimming driver 400 into a data voltage and outputs the data voltage to the display panel 110, and gate driver 230 which is synchronized with output timing of the data driver 210 and outputs a gate signal to the display panel 110.

In the present exemplary embodiment, the light source module 300 includes a first light emitting module 310, a second light emitting module 320 and a light guide plate 330. The first and second light emitting modules 310 and 320 are respectively disposed at opposing edges of the light guide plate 330, which correspond to each other. The light guide plate 330 guides light generated from the first and second light emitting modules 310 and 320 to the display panel 110.

The first light emitting module 310 is disposed adjacent to a first edge of the display panel 110. The first light emitting module 310 includes a first group of light source blocks B11, B12, B13, . . . , B1*k*, wherein 'k' is a natural number.

The second light emitting module 320 is disposed adjacent to a second edge of the display panel 110 opposite to the first edge. The second light emitting module 320 includes a second group of light source blocks B21, B22, B23, . . . , B2*m*, wherein 'm' is a natural number. The first group of light source blocks B11, B12, B13, . . . , B1*k* and the second group of light source blocks B21, B22, B23, . . . , B2*m* may be symmetrically disposed with respect to one another. In such an exemplary embodiment 'k' and 'm' may be substantially the same. In one exemplary embodiment, each of the light source blocks, e.g., such as B21, includes at least one light emitting diode ("LED"), although alternative exemplary embodiments may utilize alternative light-emitting devices, e.g., OLEDs, fluorescent lamps, incandescent lamps, etc.

The light source driver 550 divides a reference period in which the light source module 300 is driven into a plurality of periods. During a first period of the reference period, the light source driver 550 drives the first group of light source blocks B11, B12, B13, . . . , B1*k*. During a second period of the reference period, the light source driver 550 drives the second group of light source blocks B21, B22, B23, . . . , B2*m*. In one exemplary embodiment, the reference period corresponds to a frame period, that is to say a period during which a single frame is displayed on the display panel 110. The first and second periods may be dependent on luminance of a frame image displayed on the display panel 110.

For example, in one exemplary embodiment the light source driver 550 includes the dimming driver 400 and a signal generator 500. The dimming driver 400 includes a dimming level decision part 410, a cycle decision part 420, a boosting decision part 430, a spatial low pass filter ("LPF") 440, a time LPF 450 and a grayscale compensating part 460.

The dimming level decision part 410 divides a frame image received from an outside, e.g., a video source, into a plurality of first to k-th image blocks D1, D2, D3, . . . , Dk corresponding to the light source module 300. The dimming level decision part 410 calculates first to k-th representative luminance values of the first to k-th image blocks D1, D2, D3, . . . , Dk using grayscales of the first to k-th image blocks D1, D2, D3, . . . , Dk. The dimming level decision part 410 determines first to k-th duty ratio based on the first to k-th representative luminance values. In one exemplary embodiment, the first to k-th duty ratios are similarly applied to the first group of light source blocks B11, B12, B13, . . . , B1*k*, and the second group of light source blocks B21, B22, B23, . . . , B2*m* as will be described in more detail below.

The cycle decision part 420 divides the frame image into at least two partial images, and calculates a luminance ratio between a first partial image DP1 and a second partial image DP2. The first partial image DP1 is adjacent to the first group of light source blocks B11, B12, B13, . . . , B1*k*. The second partial image DP2 is adjacent to the second group of light source blocks B21, B22, B23, . . . , B2*m*. The cycle decision part 420 decides a first cycle of a first group of driving signals provided to the first group of light source blocks B11, B12, B13, . . . , B1*k* and a second cycle of a second group of driving signals provided to the second group of light source blocks B21, B22, B23, . . . , B2*m* based on the luminance ratio between the first and second partial images DP1 and DP2. For example, in an exemplary embodiment wherein the luminance ratio between the first and second partial images DP1 and DP2 is about 5:5, a ratio between the first cycle and the second cycle is about 5:5 with respect to the reference period. In an exemplary embodiment wherein the luminance ratio between the first and second partial images DP1 and DP2 is about 4:6, a ratio between the first cycle and the second cycle is about 4:6 with respect to the reference period.

The boosting decision part 430 decides to boost luminance of a light source block having a short driving period when a predetermined image having a uniform grayscale is disposed in a boundary area of the first partial image DP1 and the second partial image DP2. Exemplary embodiments of the boosting method may include boosting a peak current of a driving signal, boosting the duty ratio or boosting the peak current and the duty ratio at the same time.

For example, in one exemplary embodiment when the luminance ratio between the first and second partial images DP1 and DP2 is about 3:7 and the predetermined image having a uniform grayscale is disposed in the boundary area of the first and second groups of second light source blocks B12 and B22, the boosting decision part 430 determines to boost the luminance of the first group of second light source block B12 corresponding to the first partial image DP1 having relatively low luminance.

The spatial LPF 440 compensates each of the first to k-th duty ratios determined by the dimming level decision part 410 with respect to adjacent duty ratios via a low pass filtering process.

The time LPF 450 compensates the first to k-th duty ratios compensated by the spatial LPF 440 with respect to duty ratios of a previous frame via the low pass filtering process. In addition, the time LPF 450 compensates the first and second cycles determined by the cycle decision part 420 with respect to first and second cycles of the previous frame via the low pass filtering process. For example, in an exemplary embodiment wherein the ratio between the first and second cycles of the previous frame is about 5:5 and the ratio between the first and second cycles of the present frame is about 1:9, the time LPF 450 compensates the ratio between the first and second cycles of the present frame to about 3:7, so that a difference of ratios between the previous and present frames is decreased. Exemplary embodiments include configurations wherein an operation order of the spatial LPF 440 and the time LPF 450 may be reversed.

The grayscale compensating part 460 compensates a grayscale of the frame image based on the first to k-th duty ratios compensated by the spatial LPF 440 and the time LPF 450. A light transmittance is controlled by the compensated grayscale, and thus power consumption may be reduced. For instance, rather than operating the light source module at a constant power setting and only allowing a small portion of the light to pass through the display panel 110 at an area corresponding to a low grayscale, the present exemplary embodiment may control the light source module to operate at a lower power setting at the area corresponding to the low grayscale, and the display panel 110 may be controlled to transmit a larger portion of the light therethrough.

The signal generator 500 generates the first group of first to k-th driving signals and the second group of first to m-th driving signals. The first group of the first to k-th driving signals respectively has the first to k-th duty ratios and the first cycle. The first group of the first to k-th driving signals is provided to the first group of light source blocks B11, B12, B13, . . . , B1*k*. The second group of the first to m-th driving signals respectively has the first to k-th duty ratios and the second cycle. The second group of the first to m-th driving signals is provided to the second group of light source blocks B21, B22, B23, . . . , B2*m*. In addition, the signal generator 500 generates a light source block driving signal having a higher peak current level, which is a boosting level, than a normal peak current level according to control of the boosting decision part 430.

Referring to FIGS. 1 and 2, the display apparatus includes a display panel module 100 and the light source module 300.

The display panel module 100 includes the display panel 110, the panel driver 200 and a mold frame 150, although alternative exemplary embodiments include configurations which may omit the mold frame 150. The panel driver 200 includes the data driver 210 and the gate driver 230. In the exemplary embodiment illustrated in FIG. 2, the data driver 210 includes a data tape carrier package ("data TCP") 211 on which a data driving chip is mounted and a source printed circuit board ("source PCB") 212 transmitting electric signals from outside to the data TCP 211.

In the exemplary embodiment illustrated in FIG. 2, the gate driver 230 includes a gate tape carrier package ("gate TCP") on which a gate driving chip is mounted. Alternative exemplary embodiments include configurations wherein the gate driver 230 may be mounted on the display panel 110 as an integrated circuit ("IC") chip, or the gate driver 230 may be formed simultaneously when the display panel 110 is formed.

The mold frame 150 includes a supporting surface which supports an edge of the display panel 110. The mold frame 150 receives and fixes the display panel 110 in position. Exemplary embodiments include configurations wherein the mold frame 150 may be omitted or be substituted by a pair of side molds which are disposed at both edges of the display panel 110 substantially opposite to each other.

The light source module 300 includes the first light emitting module 310, the second light emitting module 320, the light guide plate 330 and a reflecting plate 370. The first light emitting module 310 is disposed adjacent to a first edge 330*a* of the light guide plate 330. In the present exemplary embodiment, the first light emitting module 310 includes a plurality of light emitting diodes 311 and a PCB 312 on which the plurality of light emitting diodes 311 is mounted. The second light emitting module 320 is disposed adjacent to a second edge 330*b* of the light guide plate 330 substantially opposite to the first edge 330*a*. The second light emitting module 320 includes a plurality of light emitting diodes 321 and a PCB 322 on which the plurality of light emitting diodes 321 is mounted.

The light guide plate 330 guides light generated from the first and second light emitting modules 310 and 320 to the display panel 110. The reflecting plate 370 is disposed between the light guide plate 330 and a bottom plate of a receiving container 380. The reflecting plate 370 reflects light leaked from a bottom surface of the light guide plate 330.

Exemplary embodiments include configurations wherein the light source module 300 may further include optical sheets 305 and the receiving container 380.

In the exemplary embodiment in which they are included, the optical sheets 305 may include a diffusing sheet 301, a prism sheet 302 and a condensing sheet 303. When included, the receiving container 380 receives the first and second light emitting modules 310 and 320, the light guide plate 330 and the reflecting plate 370. For example, in one exemplary embodiment the receiving container 380 may be a bottom chassis.

The display apparatus may further include a driving circuit board 560 on which circuits of the light source driver 550 are mounted. In one exemplary embodiment, the driving circuit board 560 may be disposed on a rear surface of the receiving container 380.

Figure 3:
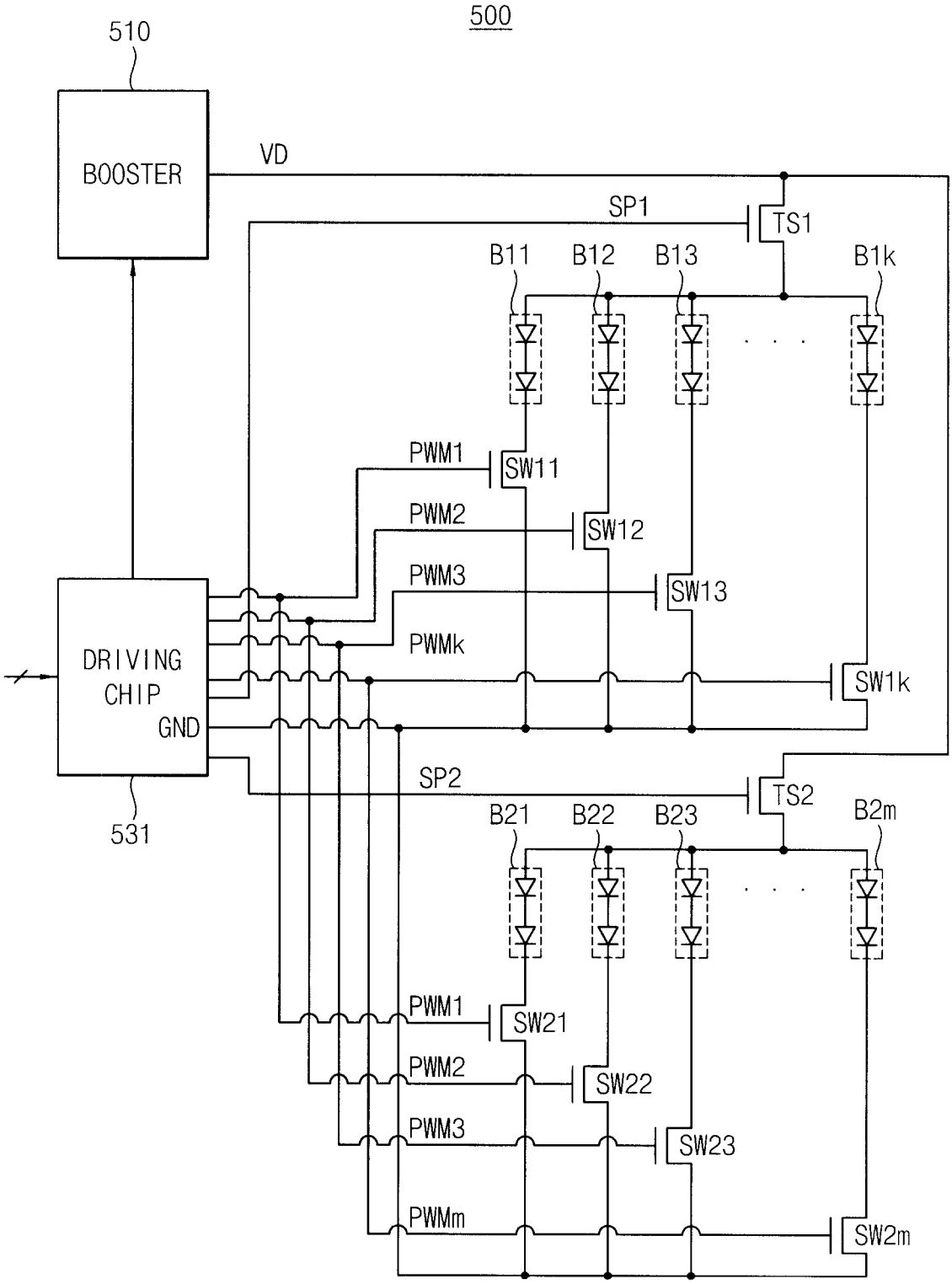
FIG. 3 is a block diagram illustrating an exemplary embodiment of a signal generator of FIG. 1.
Figure 4A:
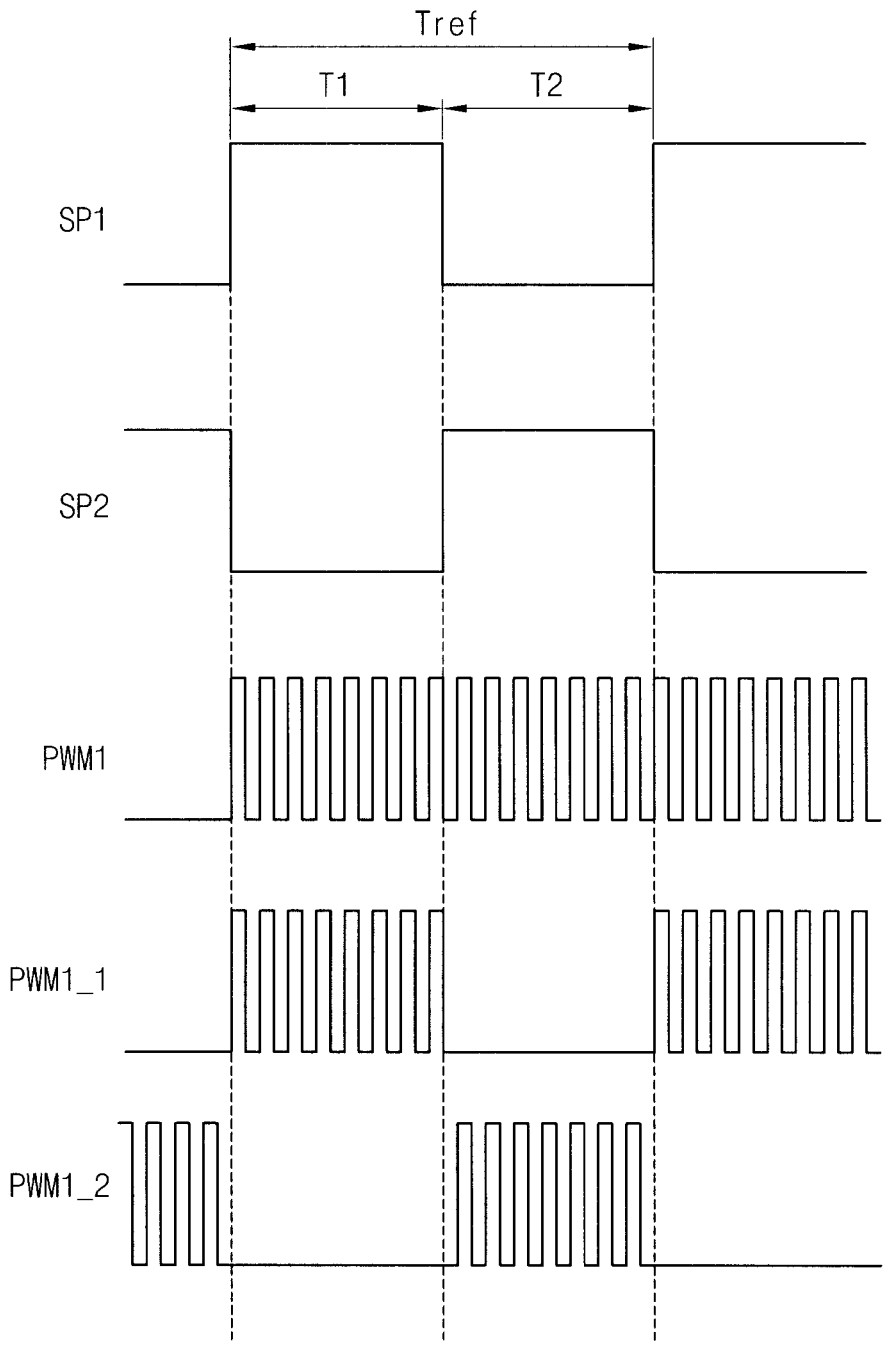
FIGS. 4A and 4B are waveform diagrams of selected signals to explain an exemplary embodiment of a driving of the exemplary embodiment of a signal generator of FIG. 3.
Figure 4B:
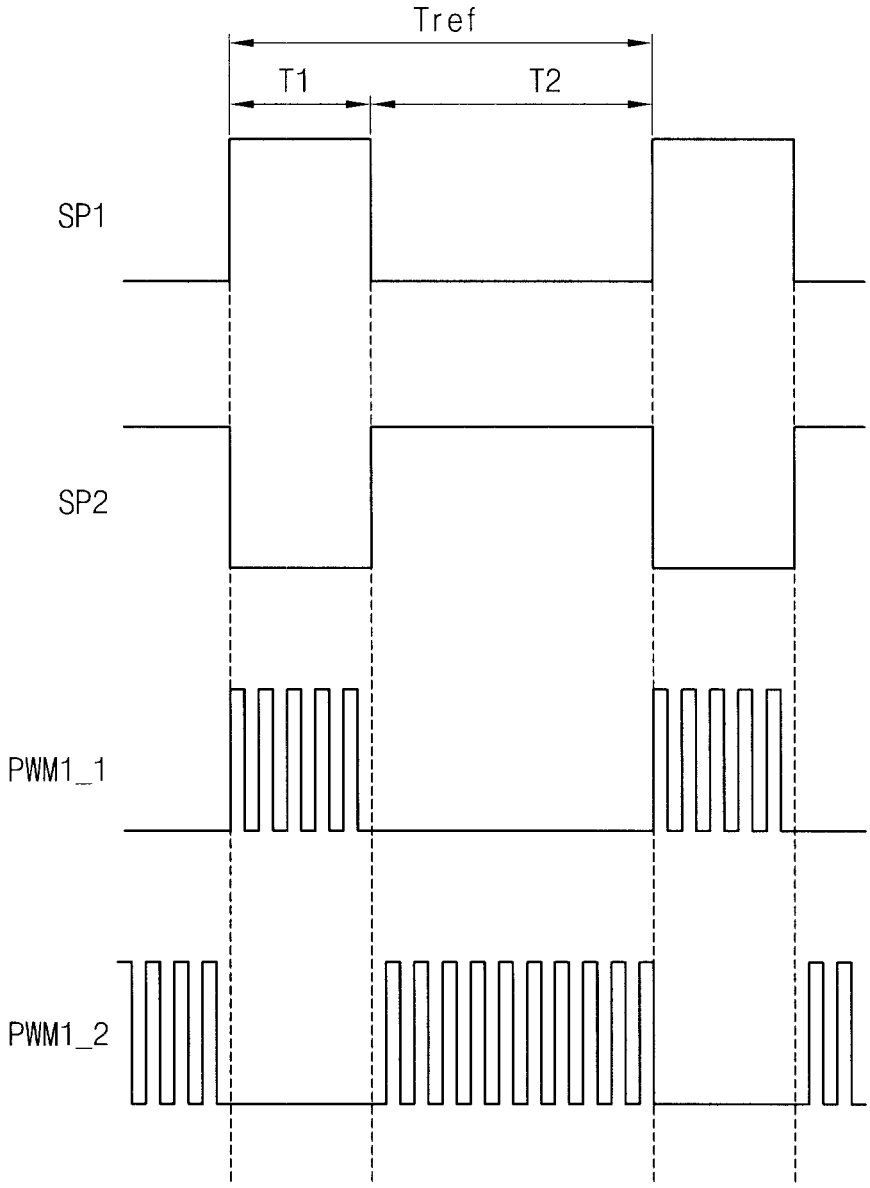

FIG. 3 is a block diagram illustrating an exemplary embodiment of a signal generator 500 of FIG. 1. FIGS. 4A and 4B are waveform diagrams of selected signals to explain an exemplary embodiment of a driving of the signal generator 500 of FIG. 3.

Referring to FIGS. 1 and 3, the signal generator 500 includes a booster 510 and a control circuit. As previously described, the light source module 300 includes the first group of first to k-th light source blocks B11, B12, B13, . . . , B1*k* and the second group of first to m-th light source blocks B21, B22, B23, . . . , B2*m*.

The booster 510 boosts an input voltage to generate a driving voltage VD.

The control circuit includes a driving chip 531, a first time division element TS1, a second time division element TS2, a first group of switching elements SW11, SW12, . . . , SW1*k* and a second group of switching elements SW21, SW22, . . . , SW2*m*.

The driving chip 531 controls driving of the signal generator 500. For example, in one exemplary embodiment the driving chip 531 generates a first selecting signal SP1 and a second selecting signal SP2 according to the first and second cycles which are provided from the cycle decision part 420. In one exemplary embodiment, the first and second selecting signals SP1 and SP2 have inversed phases with each other. The driving chip 531 generates first to k-th pulse signals PWM1, PWM2, PWM3, . . . , PWMk based on the first to k-th duty ratios. For example, in one exemplary embodiment the first and second selecting signals SP1 and SP2 have a frequency of several Hz, and the first to k-th pulse signals PWM1, PWM2, PWM3, . . . , PWMk have a frequency of several kHz.

A control electrode of the first time division element TS1 is electrically connected to the driving chip 531. An input electrode of the first time division element TS1 is electrically connected to the booster 510. An output electrode of the first time division element TS1 is electrically connected to first terminals of the first group of the light source blocks B11, B12, B13, . . . , B1*k* in common. A control electrode of the second time division element TS2 is electrically connected to the driving chip 531. An input electrode of the first time division element TS2 is electrically connected to the booster 510. An output electrode of the first time division element TS2 is electrically connected to first terminals of the second group of the light source blocks B21, B22, B23, . . . , B2*m* in common.

The first time division element TS1 provides the driving voltage VD to the first group of the light source blocks B11, B12, B13, . . . , B1*k* during the first period corresponding to the first cycle in the reference period in response to the first selecting signal SP1. The second time division element TS2 provides the driving voltage VD to the second group of the light source blocks B21, B22, B23, . . . , B2*m* during the second period corresponding to the second cycle in the reference period in response to the second selecting signal SP2.

Each control electrode of the first group of the switching elements SW11, SW12, . . . , SW1*k* is electrically connected to the driving chip 531. Each input electrode of the first group of the switching elements SW11, SW12, . . . , SW1*k* is electrically connected to second terminals of the first group of the light source blocks B11, B12, B13, . . . , B1*k*, respectively. Each control electrode of the second group of the switching elements SW21, SW22, . . . , SW2*m* is electrically connected to the driving chip 531. Each input electrode of the second group of the switching elements SW21, SW22, . . . , SW2*m* is electrically connected to second terminals of the second group of the light source blocks B21, B22, B23, . . . , B2*m*, respectively.

The first group of the switching elements SW11, SW12, . . . , SW1*k* provides the first group of the first to k-th driving signals to the first group of the light source blocks B11, B12, B13, . . . , B1*k* in response to the first to k-th pulse signals PWM1, PWM2, PWM3, . . . , PWMk. The second group of the switching elements SW21, SW22, . . . , SW2*m* provides the second group of the first to m-th driving signals to the second group of the light source blocks B21, B22, B23, . . . , B2*m* in response to the first to m-th pulse signals PWM1, PWM2, PWM3, . . . , PWMm. In the present exemplary embodiment, m is equal to k, and therefore the number of first to k-th pulse signals PWM1, PWM2, PWM3, . . . , PWMk may substantially equal the number of first to m-th pulse signals PWM1, PWM2, PWM3, . . . , PWMm, and the same wiring may be used to supply both sets of signals; therefore PWMk and PWMm will be used interchangeably in the remaining discussion unless otherwise noted.

Referring to FIG. 4A, when a ratio between the first and second cycles T1 and T2 is about 5:5 in the reference period Tref, each of pulse widths of the first and second selecting signals SP1 and SP2 is about ½ of the reference period Tref. For example, in an exemplary embodiment the first time division element TS1 is turned on and applies the driving voltage VD to the first group of the light source blocks B11, B12, B13, . . . , B1*k* during the first period, that is, an initial half of the reference period Tref, in which the first selecting signal SP1 is in a high level. Meanwhile, the second time division element TS2 is turned off and blocks the driving voltage VD to the second group of the light source blocks B21, B22, B23, . . . , B2*m* during the first period. Then, the second time division element TS2 is turned on and applies the driving voltage VD to the second group of the light source blocks B21, B22, B23, . . . , B2*m* during the second period, that is, a subsequent half of the reference period Tref, in which the second selecting signal SP2 is in the high level. At this time, the first time division element TS1 is turned off and blocks the driving voltage VD to the first group of the light source blocks B11, B12, B13, . . . , B1*k* during the second period. As a result, the first period in which the first group of light source blocks B11, B12, B13, . . . , B1*k* is driven and the second period in which the second group of light source blocks B21, B22, B23, . . . , B2*m* is driven are divided and alternated.

The first to k-th pulse signals PWM1, . . . , PWMk respectively have the first to k-th duty ratios. For example, in an exemplary embodiment when the first duty ratio is determined to be about 50% based on the luminance of the first image block D1, the first pulse signal PWM1 has a pulse width whose duty ratio is about 50%. The first pulse signal PWM1 is provided to the first group of first light source block B11 and the second group of first light source block B21. For example, in one exemplary embodiment a first driving signal PWM1_1 having the first cycle and the first duty ratio, which is about 50%, is provided to the first light source block B11. A first driving signal PWM1_2 having the second cycle and the first duty ratio, which is about 50%, is provided to the second light source block B21.

Referring to FIG. 4B, in an exemplary embodiment wherein the ratio between the first and second cycles in the reference period Tref is about 3:7, a pulse width of the first selecting signal SP1 is about 3/10 of the reference period Tref and a pulse width of the second selecting signal SP2 is about 7/10 of the reference period Tref.

In such an exemplary embodiment, the first to m-th driving signals, for example a signal such as PWM1_2, which are provided to the second group of the light source blocks B21, B22, B23, . . . , B2*m* have a longer cycle than the first to k-th driving signals such as PWM1_1 which are provided to the first group of the light source blocks B11, B12, B13, . . . , B1*k*. Therefore, driving time for the second group of the light source blocks B21, B22, B23, . . . , B2*m* is longer than driving time for the first group of the light source blocks B11, B12, B13, . . . , B1*k*. The second partial image DP2 corresponding to the second group of the light source blocks B21, B22, B23, . . . , B2*m* have higher luminance than the first partial image DP1 corresponding to the first group of the light source blocks B11, B12, B13, . . . , B1*k* due to the increased driving time of the second group of the light source blocks B21, B22, B23, . . . , B2*m*.

By controlling the first cycle of the first group of the first to k-th driving signals and the second cycle of the second group of the first to m-th driving signals based on the luminance ratios between the first partial image DP1 and the second partial image DP2, a two-dimensional dimming effect may be obtained in a one-dimensional dimming method.

Figure 5:
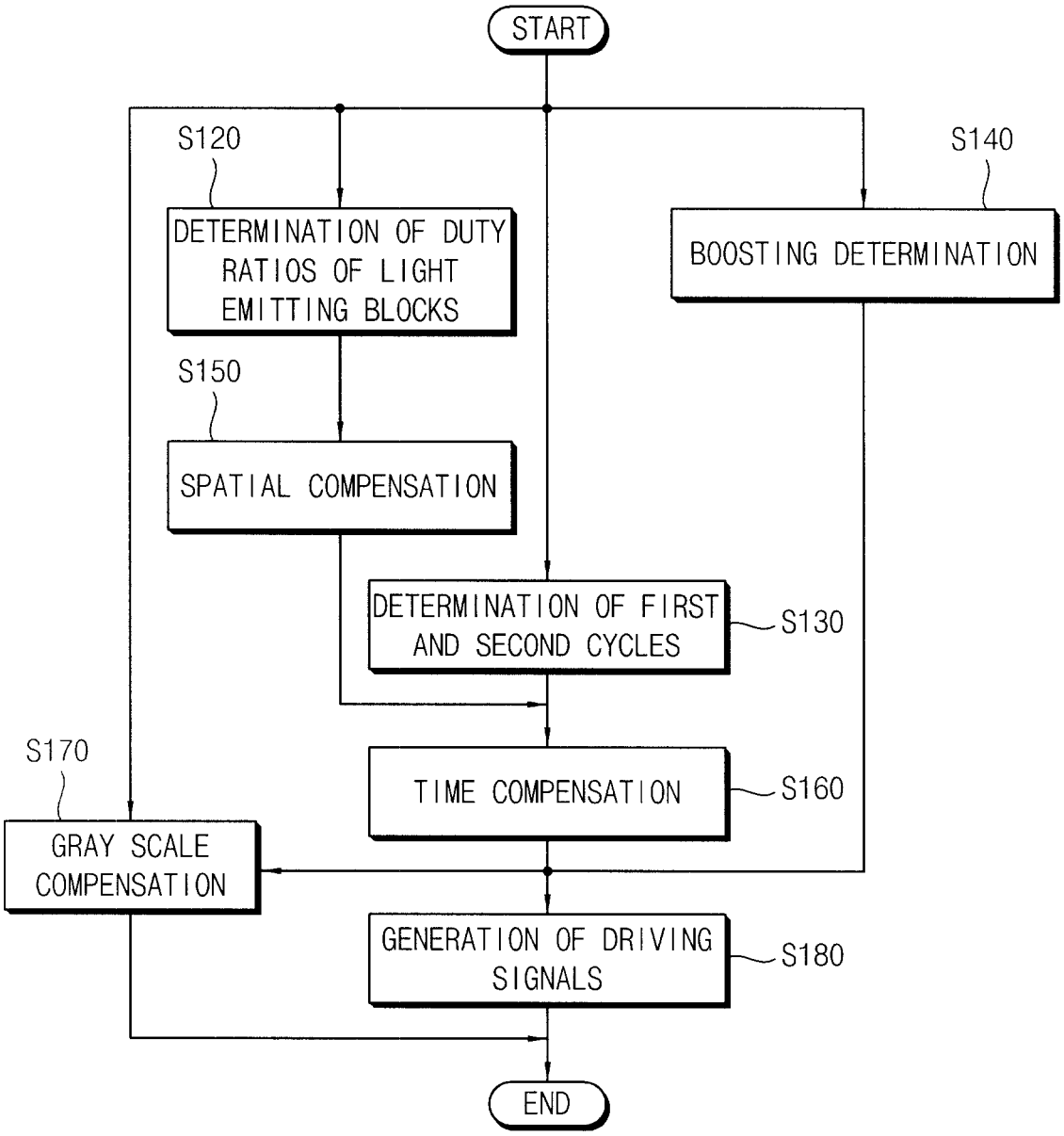
FIG. 5 is a flowchart illustrating an exemplary embodiment of a method of dimming the exemplary embodiment of a display apparatus of FIG. 1.

FIG. 5 is a flowchart illustrating a method of dimming the display apparatus of FIG. 1.

Referring to FIGS. 1 to 5, the dimming level decision part 410 determines the first to k-th duty ratios using the grayscales of the first to k-th image blocks D1, D2, D3, . . . , Dk (step S120).

Then, the cycle decision part 420 determines the first cycle T1 of the first group of the driving signals and the second cycle T2 of the second group of the driving signals based on the luminance ratio between the first and second partial images DP1 and DP2 (step S130).

The boosting decision part 430 determines whether or not to boost luminance of a light source block having low luminance and short driving period when a predetermined image having a uniform grayscale is disposed in a boundary area of the first partial image DP1 and the second partial image DP2 (step S140).

The spatial LPF 440 compensates each of the first to k-th duty ratios with respect to the adjacent duty ratios via the low pass filtering process (step S150).

Then, the time LPF 450 compensates each of the first to k-th duty ratios compensated by the spatial LPF 440 with respect to duty ratios of the previous frame via the low pass filtering process. In addition, the time LPF 450 compensates the first and second cycles T1 and T2 with respect to the first and second cycles T1 and T2 of the previous frame via the low pass filtering process (step S160).

The grayscale compensating part 460 compensates the grayscale of the frame image based on the compensated first to k-th duty ratios (step S170).

The signal generator 500 then generates the first group of first to k-th driving signals and the second group of first to m-th driving signals based on the compensated first to k-th duty ratios and the first and second cycles T1 and T2 (step S180).

Figure 6:
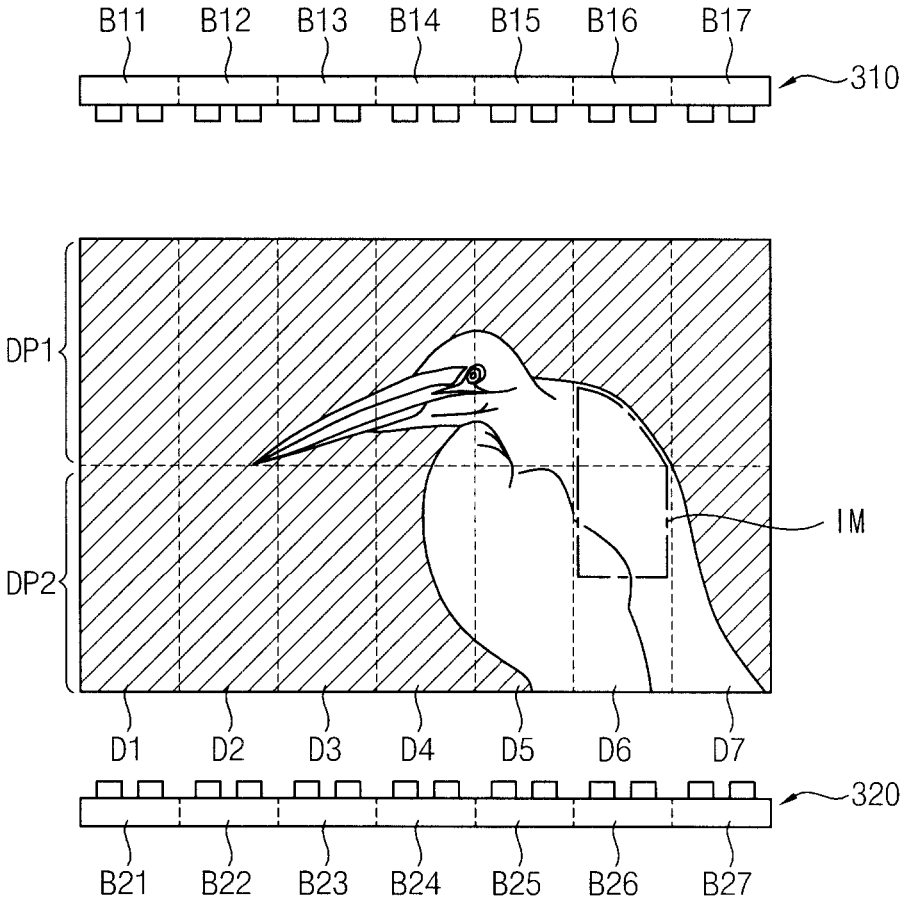
FIG. 6 is a conceptual diagram illustrating a test image displayed on the exemplary embodiment of a display apparatus of FIG. 1.
Figure 7A:
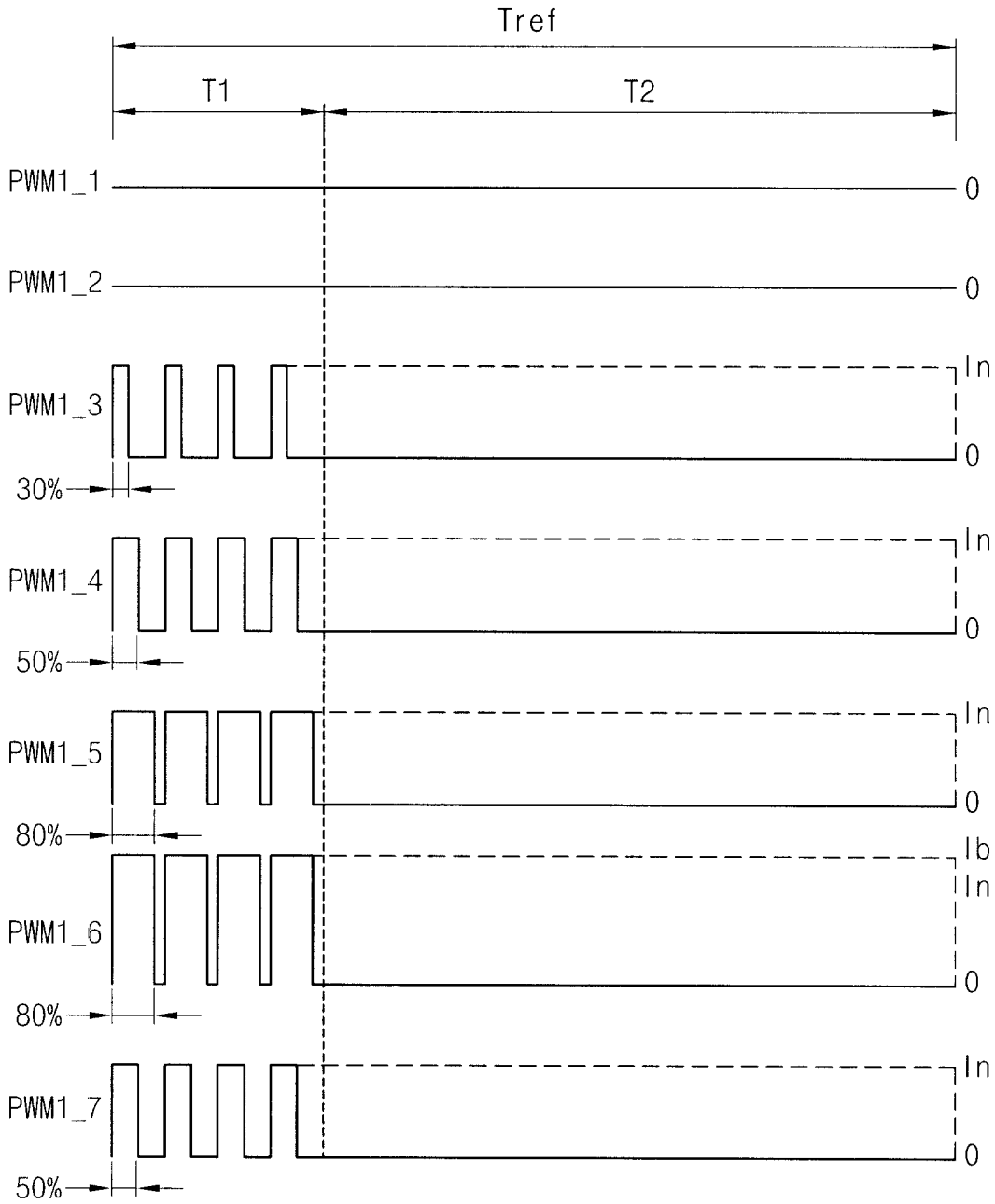
FIGS. 7A and 7B are waveform diagrams of driving signals for displaying the test image of FIG. 6.
Figure 7B:
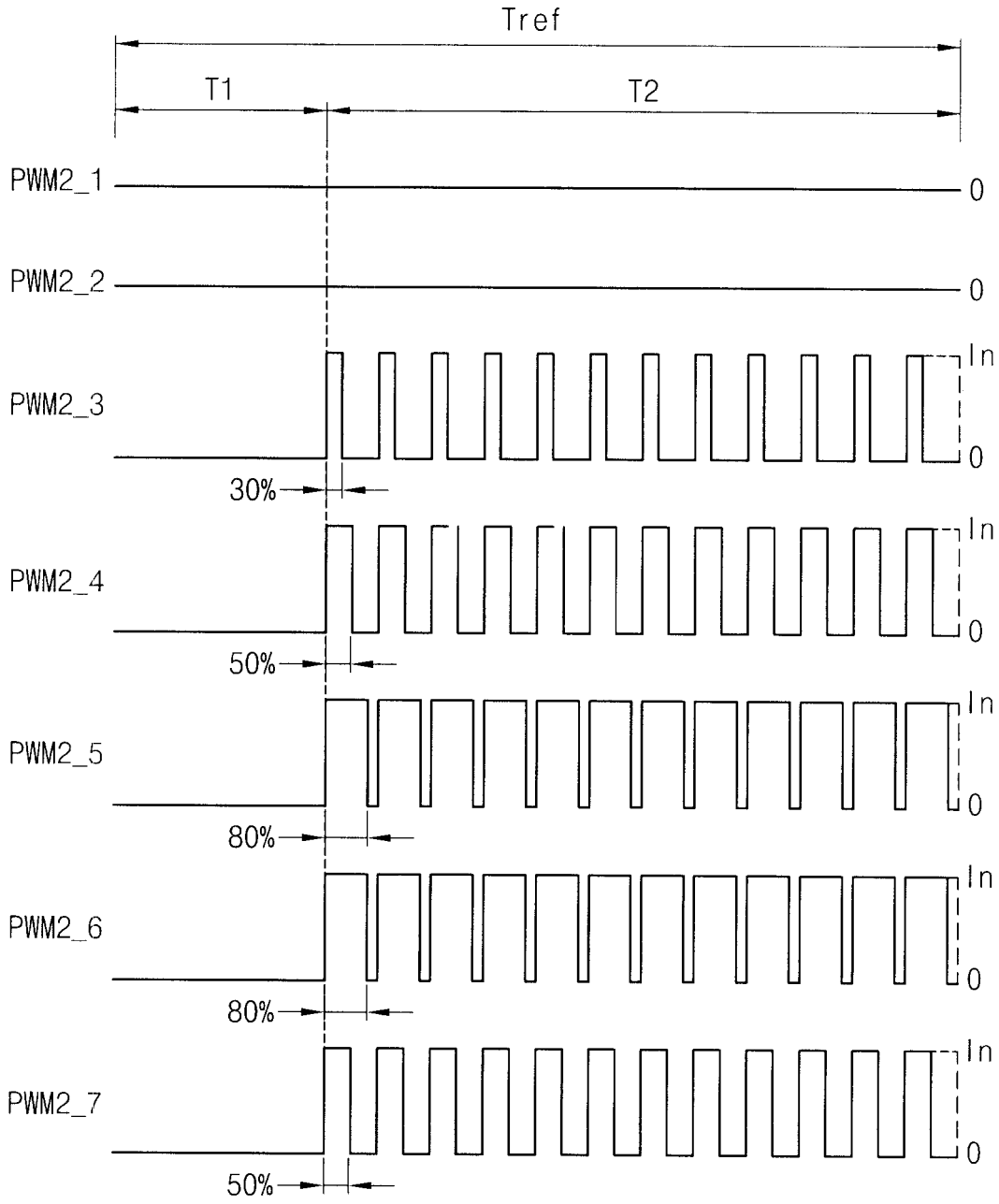

FIG. 6 is a conceptual diagram illustrating an exemplary embodiment of a test image displayed on the display apparatus of FIG. 1. FIGS. 7A and 7B are waveform diagrams of driving signals for displaying the test image of FIG. 6.

Referring to FIGS. 1, 6, 7A and 7B, the dimming level decision part 410 determines first to seventh duty ratios respectively corresponding to first to seventh image blocks of the test image D1, D2, . . . , D7. For example, in one exemplary embodiment the dimming level decision part 410 determines duty ratios of driving signals for the first and second light source blocks B11, B12, B21 and B22 providing the light to the first and second image blocks D1 and D2 to be about 0%. The dimming level decision part 410 determines the duty ratio of the driving signal for the third light source blocks B13 and B23 providing the light to the third image block D3 to be about 30%. The dimming level decision part 410 determines the duty ratios of the driving signals for the fourth and seventh light source blocks B14, B24 and B17 and B27, respectively providing the light to the fourth and seventh image blocks D4 and D7, to be about 50%. The dimming level decision part 410 determines the duty ratios of the driving signals for the fifth and sixth light source blocks B15, B25 and B16 and B26 providing the light to the fifth and sixth image blocks D5 and D6 to be about 80%.

The cycle decision part 420 divides the test image into two partial images. The first partial image DP1 is adjacent to the first light emitting module 310 and the second partial image DP2 is adjacent to the second light emitting module 320. The cycle decision part 420 determines the first and second cycles T1 and T2 based on the luminance ratio between the first and second partial images DP1 and DP2. For example, in an exemplary embodiment when the luminance ratio is about 2:8, the cycle decision part 420 determines the first cycle T1 of first to seventh driving signals PWM1_1, PWM1_2, . . . , PWM1_7 provided to the first group of light source blocks B11, B12, . . . , B17 to be about 2/10 of the reference period Tref and the second cycle T2 of first to seventh driving signals PWM2_1, PWM2_2, . . . , PWM2_7 provided to the second group of light source blocks B21, B22, . . . , B27 to be about 8/10 of the reference period Tref.

The boosting decision part 430 determines to boost luminance of a sixth light source block B16 of the first group of the light source blocks having lower luminance and shorter cycle between sixth light source blocks B16 and B26 of the first and second groups of the light source blocks providing the light to a predetermined image IM having a uniform grayscale. The predetermined image IM is included in the sixth image block D6. The sixth image block D6 receives the light from the sixth light source block B16 of the first group of the light source blocks and the sixth light source block B26 of the second group of the light source blocks. According to the cycle decision part 420, the sixth light source block B16 of the first group is driven with the lower luminance because the sixth light source block B16 of the first group corresponding to the first partial image DP1 has a shorter driving period than the sixth light source block B26 of the second group corresponding to the second partial image DP2. Therefore, the boosting decision part 430 decides to boost the sixth light source block B16 of the first group to prevent luminance deviation of the predetermined image IM. Specifically, because a portion of the sixth display block D6 includes an image having a uniform grayscale and the partial images of the sixth display block D6 would be supplied with different luminances from the corresponding sixth light source blocks B16 and B26 of the first and second light-emitting modules 310 and 320, the boosting decision part 430 boosts the sixth light source block B16 of the first light-emitting module 310 to prevent a discrepancy in the luminance of the sixth display block over the first and second partial images.

The signal generator 500 provides the first to seventh driving signals PWM1_1, PWM1_2, . . . , PWM1_7 to the first group of the light source blocks B11, B12, . . . , B17 during the first period corresponding to the first cycle T1, which is about 2/10 of the reference period Tref, and provides the first to seventh driving signals PWM2_1, PWM2_2, . . . , PWM2_7 to the second group of the light source blocks B21, B22, . . . , B27 during the second period corresponding to the second cycle T2, which is about 8/10 of the reference period Tref according to control of the dimming level decision part 410, the cycle decision part 420 and the boosting decision part 430. A peak current level of the sixth driving signal PWM1_6 of the first group of the driving signals has a boosting level Ib which is greater than a normal peak current level In of the remaining non-boosted driving signals. That is, peak current levels of the driving signals except the sixth driving signal PWM1_6 of the first group have a normal level In which is lower than the boosting level Ib. As discussed above, adjusting the peak current of the boosted driving signal is only one exemplary embodiment of a method of boosting the driving signal.

As shown in FIG. 7A, the first to seventh driving signals PWM1_1, PWM1_2, . . . , PWM1_7 having the pulse widths corresponding to the first to seventh duty ratios are provided to the first group of the light source blocks B11, B12, . . . , B17 only during the first period corresponding to the first cycle T1, which is about 2/10 of the reference period Tref.

In the present exemplary embodiment, the first and second driving signals PWM1_1 and PWM1_2, which have a low peak current level and have a duty ratio of about 0%, are provided to the first and second light source blocks B11 and B12, respectively, of the first group. The third driving signal PWM1_3, which has a normal peak current level In and has a duty ratio of about 30%, is provided to the third light source block B13 of the first group. The fourth driving signal PWM1_4, which has the normal peak current level In and has a duty ratio of about 50%, is provided to the fourth light source block B14 of the first group. The fifth driving signal PWM1_5, which has the normal peak current level In and has a duty ratio of about 80%, is provided to the fifth light source block B15 of the first group. The sixth driving signal PWM1_6, which has a boosting peak current level Ib and has a duty ratio of about 80%, is provided to the sixth light source block B16 of the first group. The seventh driving signal PWM1_7, which has the normal peak current level In and has a duty ratio of about 50%, is provided to the seventh light source block B17 of the first group.

As shown in FIG. 7B, the first to seventh driving signals PWM2_1, PWM2_2, . . . , PWM2_7 having the pulse widths corresponding to the first to seventh duty ratios, e.g., the same duty ratios as the first to seventh driving signals PWM1_1, PWM1_2, . . . PWM1_7, are provided to the second group of the light source blocks B21, B22, . . . , B27 during the second period corresponding to the second cycle T2, which is about 8/10 of the reference period Tref.

The first and second driving signals PWM2_1 and PWM2_2, which have the low peak current level and a duty ratio of about 0% are provided to the first and second light source blocks B21 and B22 of the second group. The third driving signal PWM2_3 having a duty ratio of about 30% is provided to the third light source block B23 of the second group. The fourth driving signal PWM2_4 having a duty ratio of about 50% is provided to the fourth light source block B24 of the second group. The fifth driving signal PWM2_5 having a duty ratio of about 80% is provided to the fifth light source block B25 of the second group. The sixth driving signal PWM2_6 having a duty ratio of about 80% is provided to the sixth light source block B26 of the second group. The seventh driving signal PWM2_7 having a duty ratio of about 50% is provided to the seventh light source block B27 of the second group. In the illustrated exemplary embodiment, the third to seventh driving signals PWM2_3, PWM2_4, PWM2_5, PWM2_6 and PWM2_7 have the normal peak current level In. The peak current level, the duty ratios and the periods of the first and second cycles T1 and T2 may be adjusted according to the displayed image, the above discussion applying to the exemplary embodiment of an image illustrated in FIG. 6.

Hereinafter, as another exemplary embodiment of the boosting decision part of FIG. 1, a boosting driving method which applies a motion-adaptive luminance curve will be explained.

Figure 8:
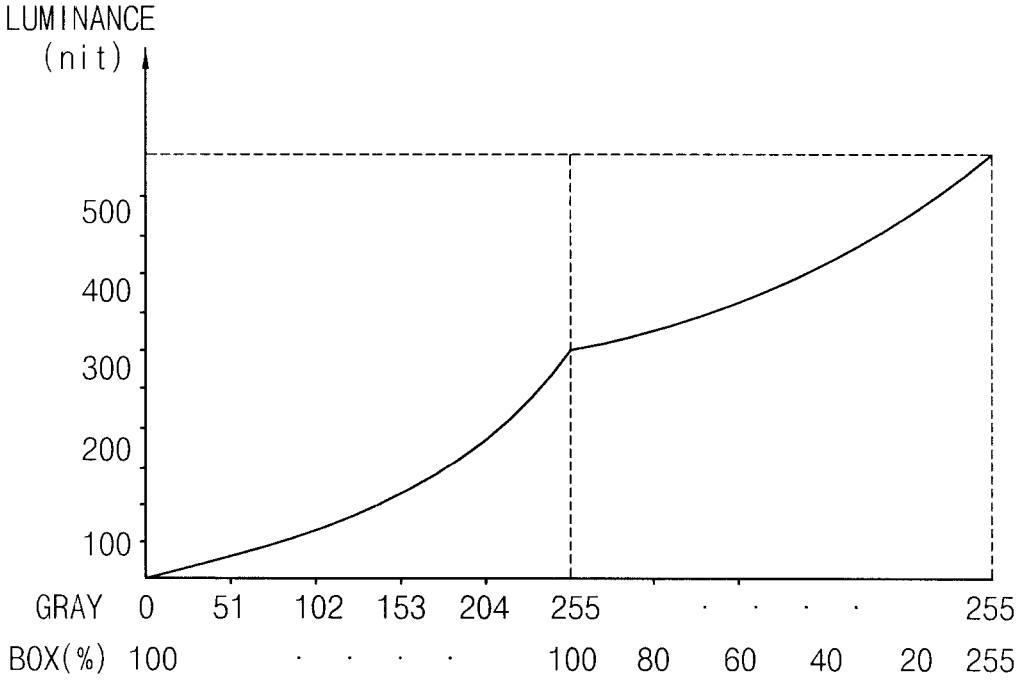
FIG. 8 is a graph illustrating a motion-adaptive luminance curve.

FIG. 8 is a graph illustrating a motion-adaptive luminance curve.

Referring to FIG. 8, according to the motion-adaptive luminance curve, as an average grayscale of the frame image increases from 0 to a preset grayscale, such as 255 grayscale in an 8 bit display, the luminance increases from 0 to a normal luminance level, such as 300 nit, according to a first gamma characteristic. Meanwhile, when the average grayscale reaches the preset grayscale, such as 255 grayscale, the luminance then changes based on an area of a relatively bright image BOX on the frame according to a second gamma characteristic. As shown in FIG. 8, as the area of the relatively bright image BOX decreases from 100% to 0% on the frame, the luminance increases from the normal luminance level, such as 300 nit, to a maximum luminance level, such as same as or more than 500 nit. For example, in a frame wherein the average grayscale is less than the predetermined grayscale, such as 255 grayscale, the luminance is determined according to the first gamma cure, and when the average grayscale is greater than the predetermined grayscale the luminance of the bright image BOX is determined according to the second gamma curve according to the percentage of the frame over which the bright image BOX is displayed.

According to the motion-adaptive luminance curve, as the area of the relatively bright image BOX decreases, the luminance increases and a contrast ratio increases. Thus, a display quality may be improved.

Figure 9A:
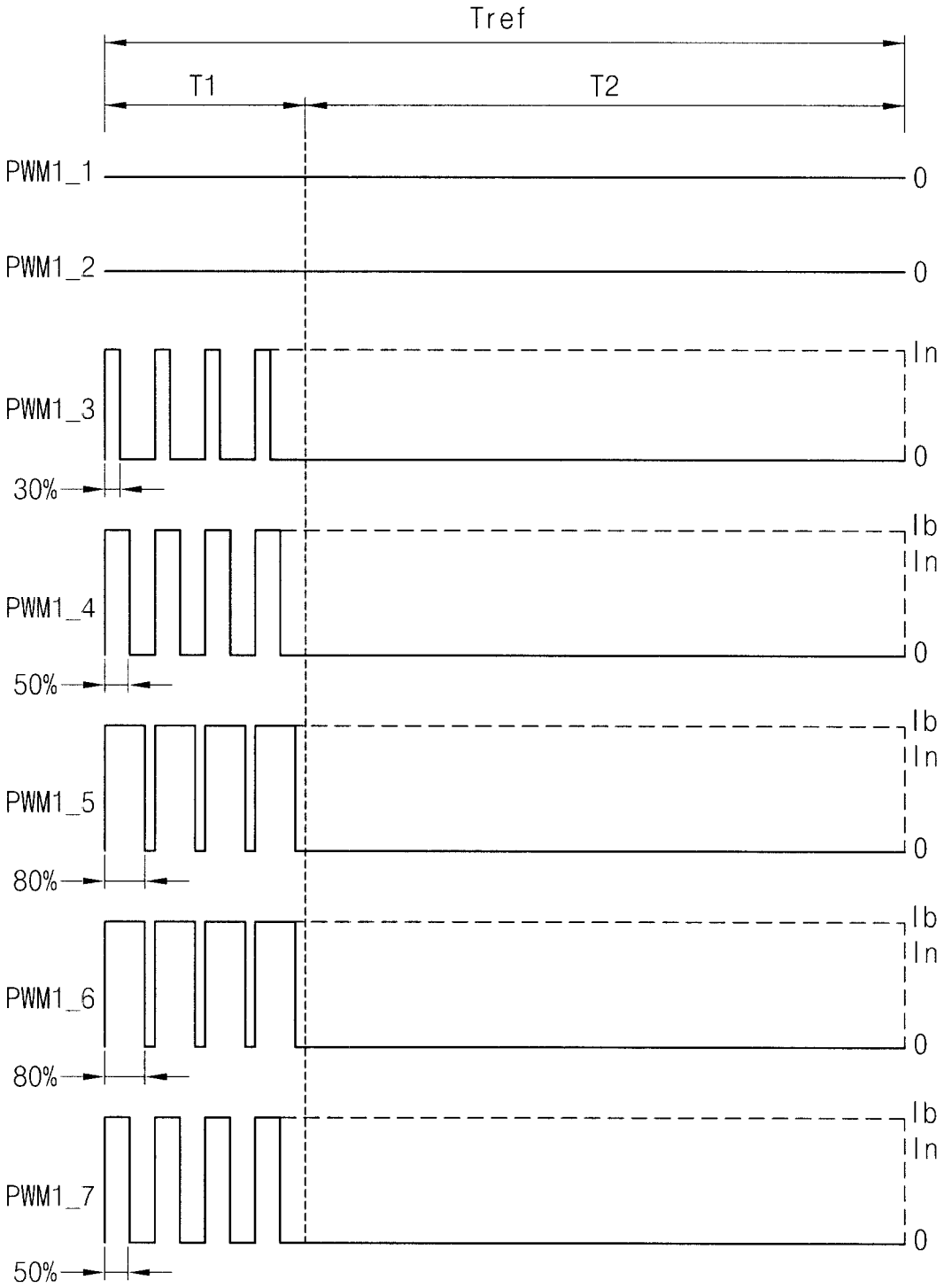
FIGS. 9A and 9B are waveform diagrams of driving signals for displaying the test image of FIG. 6 according to the motion-adaptive luminance curve of FIG. 8.
Figure 9B:
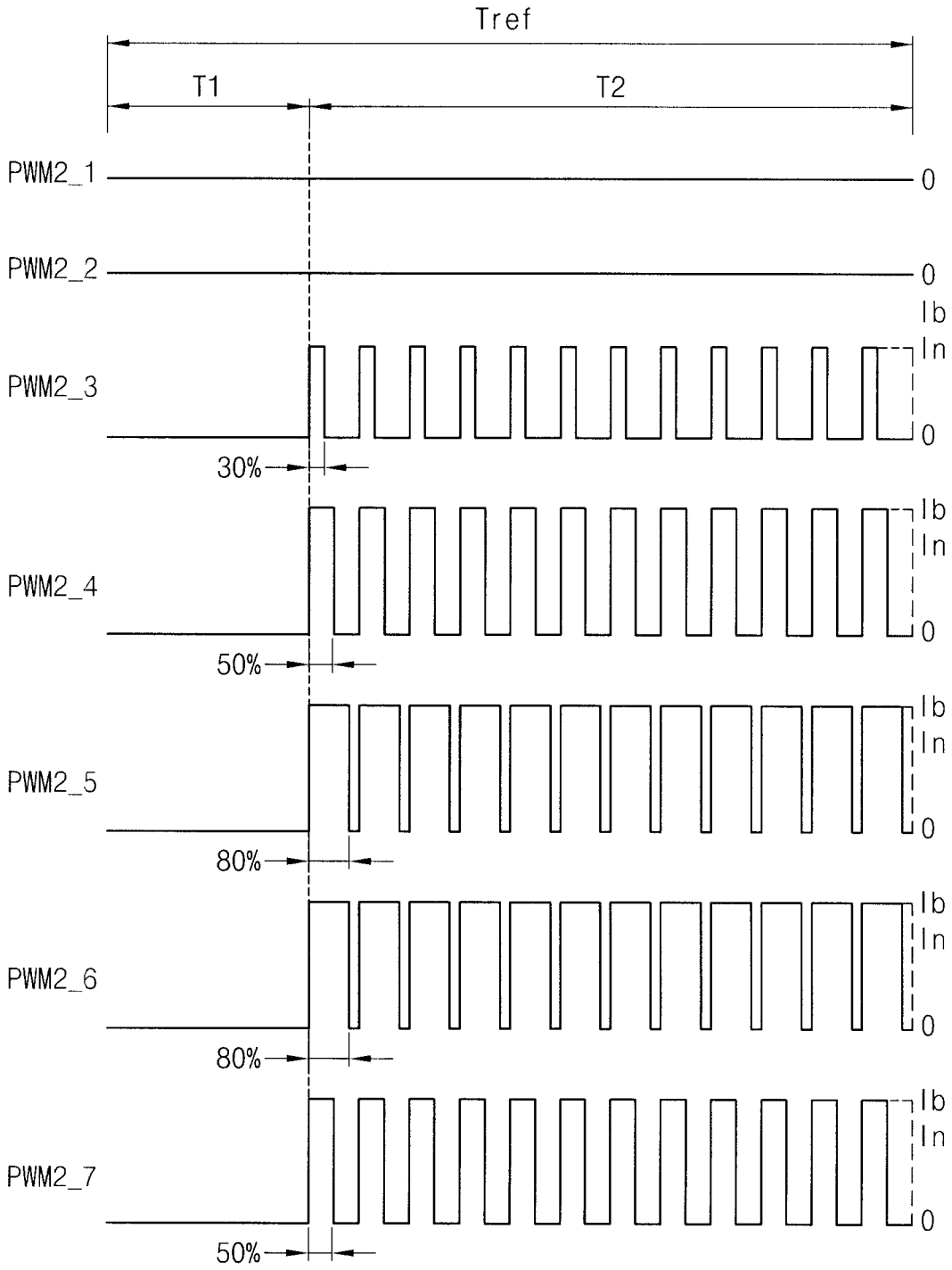

FIGS. 9A and 9B are waveform diagrams of driving signals for displaying the test image of FIG. 6 according to the motion-adaptive luminance curve of FIG. 8.

Referring to FIGS. 6, 8, 9A and 9B, as illustrated in FIGS. 9A and 9B, the dimming driver 400 determines the first cycle T1, the second cycle T2 and the first to seventh duty ratios based on the test image in FIG. 6. In addition, the dimming driver 400 decides the peak current level according to the area of the relatively bright image BOX.

For example, in an exemplary embodiment wherein a ratio of the area of the relatively bright image is about 40% of a total area of the frame image, the dimming driver 400 decides the peak current level of the fourth to seventh driving signals for luminance of the fourth to seventh light source blocks B14, B24, B15, B25, B16, B26, B17 and B27 to be about 440 nit.

Thus, as shown in FIGS. 9A and 9B, the fourth driving signals PWM1_4 and PWM2_4 provided to the fourth light source blocks B14 and B24, the fifth driving signals PWM1_5 and PWM2_5 provided to the fifth light source blocks B15 and B25, the sixth driving signals PWM1_6 and PWM2_6 provided to the sixth light source blocks B16 and B26 and the seventh driving signals PWM1_7 and PWM2_7 provided to the seventh light source blocks B17 and B27 have the boosting current level Ib which is higher than the normal current level In.

Therefore, since the relatively bright image BOX has higher luminance than the luminance mentioned in FIGS. 7A and 7B, the contrast ratio of the test image may be increased. In addition, since power for driving of the first to third light source blocks B11, B21, B12, B22, B13 and B23, which have low luminance, may be used for driving of the fourth to seventh light source blocks B14, B24, B15, B25, B16, B26, B17 and B27, efficiency of the power consumption of the entire display may be improved.

Figure 10:
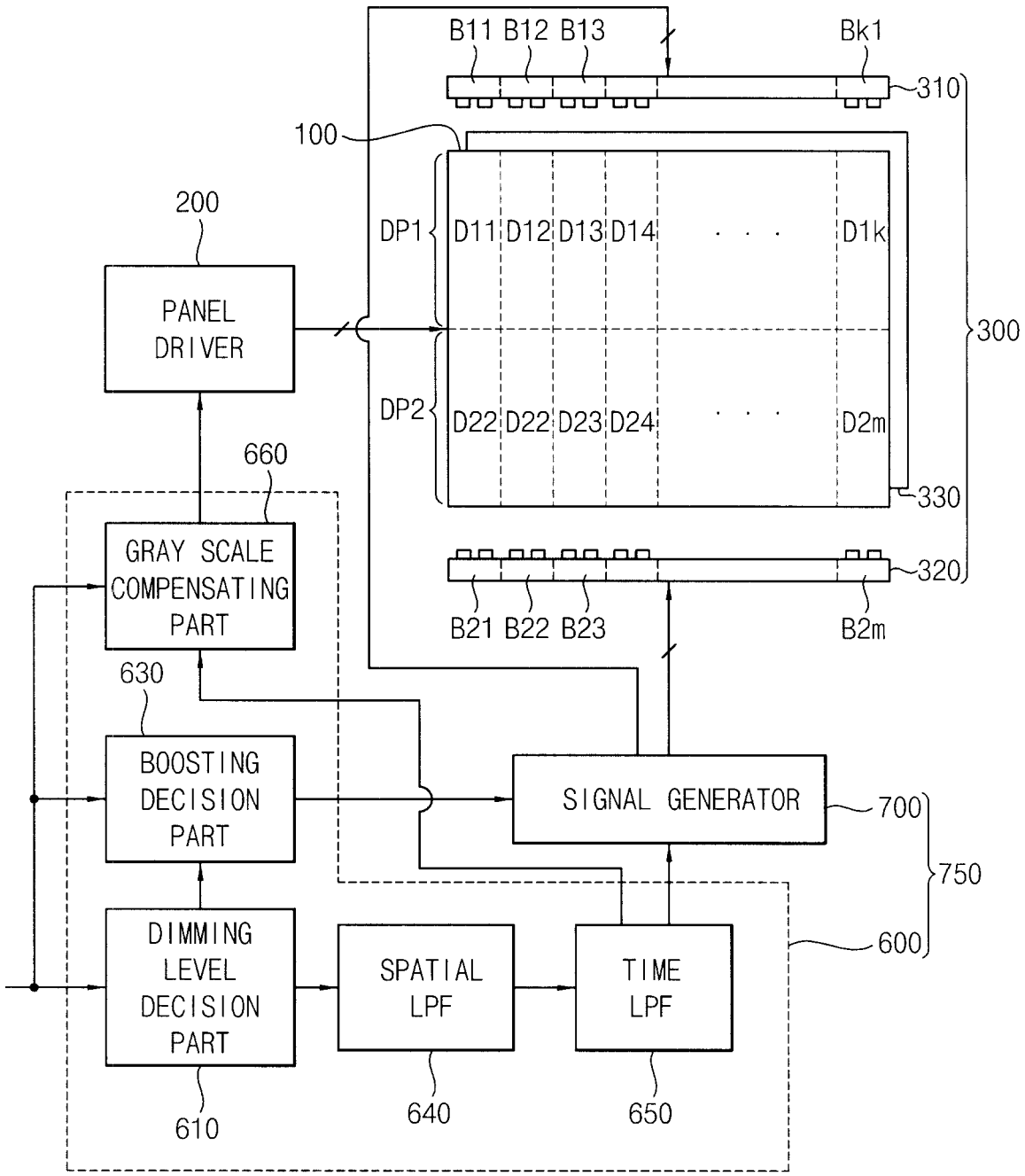
FIG. 10 is a block diagram illustrating another exemplary embodiment of a display apparatus according to the present invention.

FIG. 10 is a block diagram illustrating another exemplary embodiment of a display apparatus according to the present invention.

Figure 11:
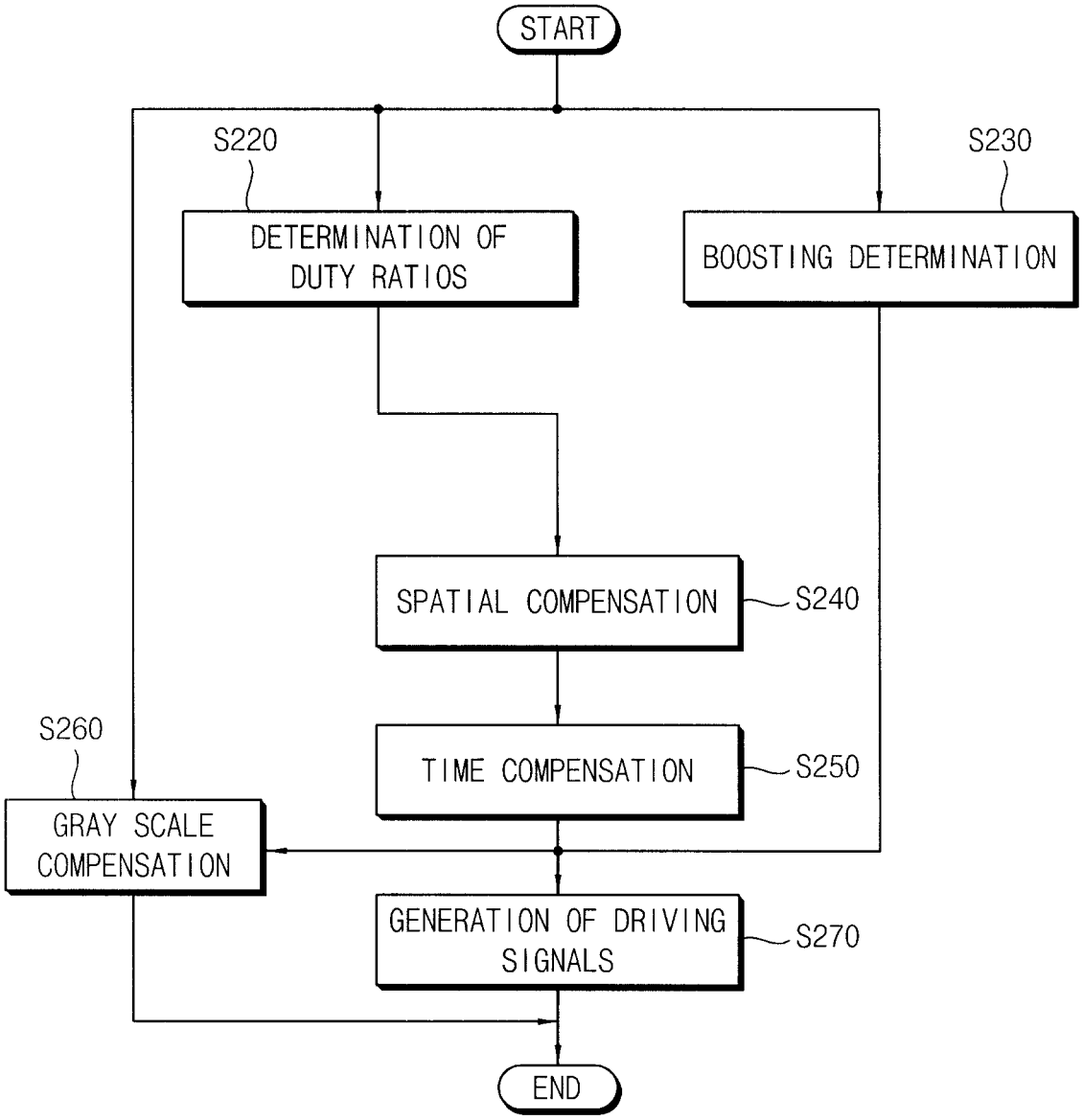
FIG. 11 is a flowchart illustrating an exemplary embodiment of a method of dimming the exemplary embodiment of a display apparatus of FIG. 10.

Referring to the FIGS. 2, 10 and 11, the present exemplary embodiment of a display apparatus includes a display panel 110, a panel driver 200, a light source module 300 and a light source driver 750. Hereinafter, the current exemplary embodiment of a display apparatus is substantially the same as the previous exemplary embodiment of a display apparatus except for the above-mentioned elements. Thus, the same reference numerals will be used to refer to the same or like parts as those described in the previous exemplary embodiment and any further repetitive explanation will be omitted.

The light source driver 750 includes a dimming driver 600 and a signal generator 700. The dimming driver 600 includes a dimming level decision part 610, a boosting decision part 630, a spatial LPF 640, a time LPF 650 and a grayscale compensating part 660; however, a cycle decision part is omitted in the present exemplary embodiment.

The dimming level decision part 610 divides a frame image received from an outside into a plurality of image blocks, wherein the plurality of image blocks includes a first group of image blocks D11, D12, D13, . . . , D1*k* and a second group of image blocks D21, D22, D23, . . . , D2*m* respectively corresponding to the first and second groups of light source blocks B11, B12, B13, . . . , B1*k*, and B21, B22, B23, . . . , B2*m*. The dimming level decision part 610 determines a first group of duty ratios corresponding to the first group of light source blocks B11, B12, B13, . . . , B1*k* and a second group of duty ratios corresponding to the second group of light source blocks B21, B22, B23, . . . , B2*m* based on the representative luminance values (step S220). In the present exemplary embodiment duty ratios of substantially oppositely disposed light source blocks, e.g., light source blocks B11 and B21, may be different from one another as will be discussed in more detail below.

The boosting decision part 630 determines whether to boost luminance of a light source block having relatively lower luminance and a smaller duty ratio when an image having a uniform grayscale receives light from the plurality of image blocks (step S230). Exemplary embodiments of the boosting method may include boosting a peak current of a driving signal, boosting the duty ratio or boosting both the peak current and the duty ratio at the same time.

The spatial LPF 640 compensates each of the first group of the duty ratios and the second group of the duty ratios with respect to adjacent duty ratios via a low pass filtering process (step S240).

The time LPF 650 compensates each of the first and second groups of the duty ratios compensated by the spatial LPF 640 with respect to duty ratios of the previous frame via the low pass filtering process (step S250). Exemplary embodiments include configurations wherein an operation order of the spatial LPF (step S240) and the time LPF (step S250) may be reversed.

The grayscale compensating part 660 compensates grayscales of the image blocks based on the first and second groups of the duty ratios (step S260). A light transmittance is controlled by the compensated grayscales, and thus power consumption may be reduced.

The signal generator 700 generates the first group of first to k-th driving signals and the second group of first to m-th driving signals based on the first and second groups of the duty ratios (step S270). In addition, the signal generator 700 may generate a light source block driving signal having a higher peak current level, which is a boosting level, than a normal peak current level according to a control signal provided from the boosting decision part 630.

Figure 12:
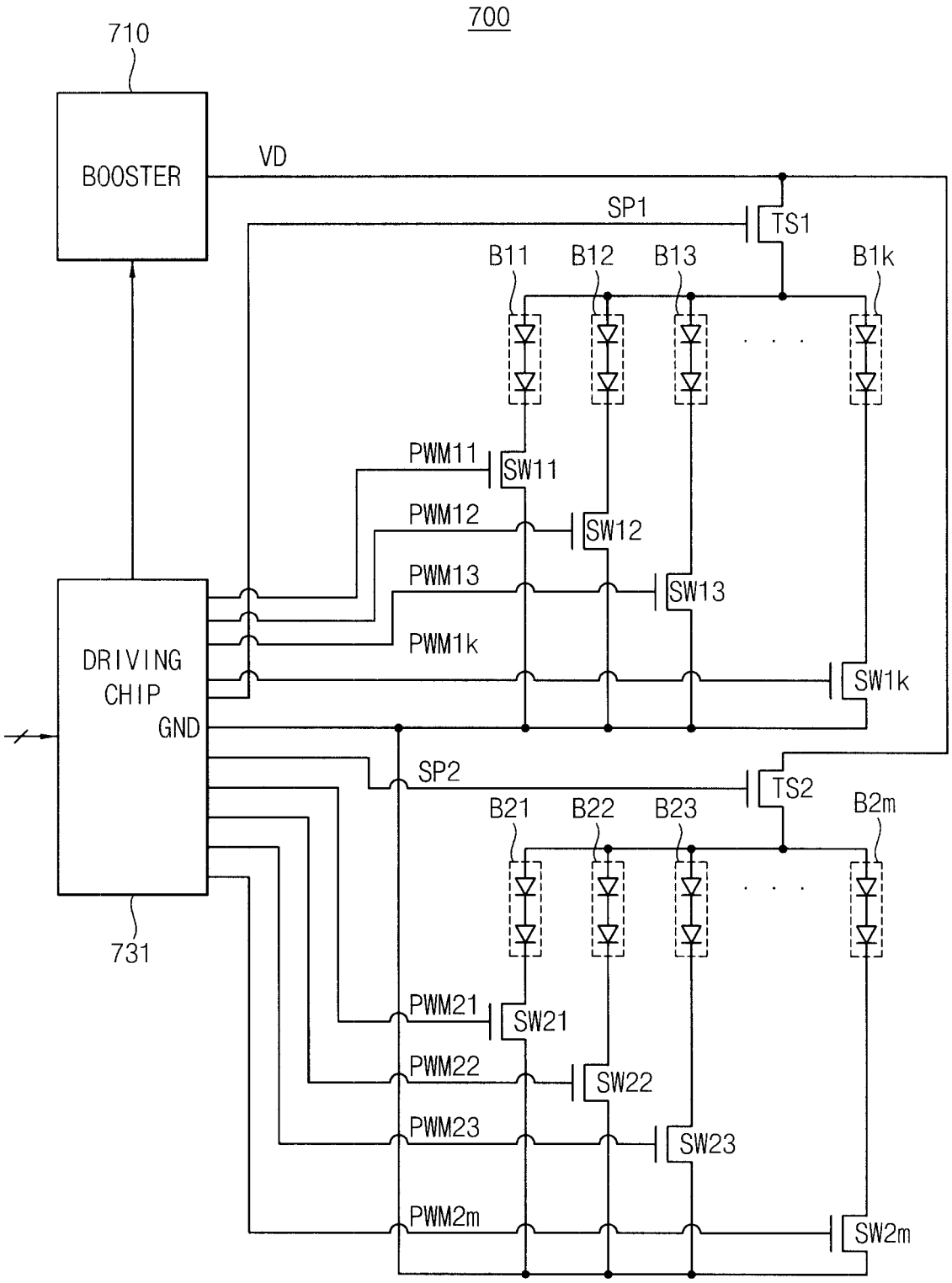
FIG. 12 is a block diagram illustrating an exemplary embodiment of a signal generator of FIG. 10.

FIG. 12 is a block diagram illustrating an exemplary embodiment of a signal generator of FIG. 10. Hereinafter, the same reference numerals will be used to refer to the same or like parts as those described in the previous exemplary embodiment of FIG. 3.

Referring to FIGS. 10 and 12, the signal generator 700 includes a booster 710 and a control circuit. The light source module 300 includes the first group of the first to k-th light source blocks B11, B12, B13, . . . , B1*k* and the second group of the first to m-th light source blocks B21, B22, B23, . . . , B2*m*.

The booster 710 generates a driving voltage VD by boosting an input voltage.

The control circuit includes a driving chip 731, a first time division element TS1, a second time division element TS2, a first group of switching elements SW11, SW12, . . . , SW1*k* and a second group of switching elements SW21, SW22, . . . , SW2*m*.

Figure 14A:
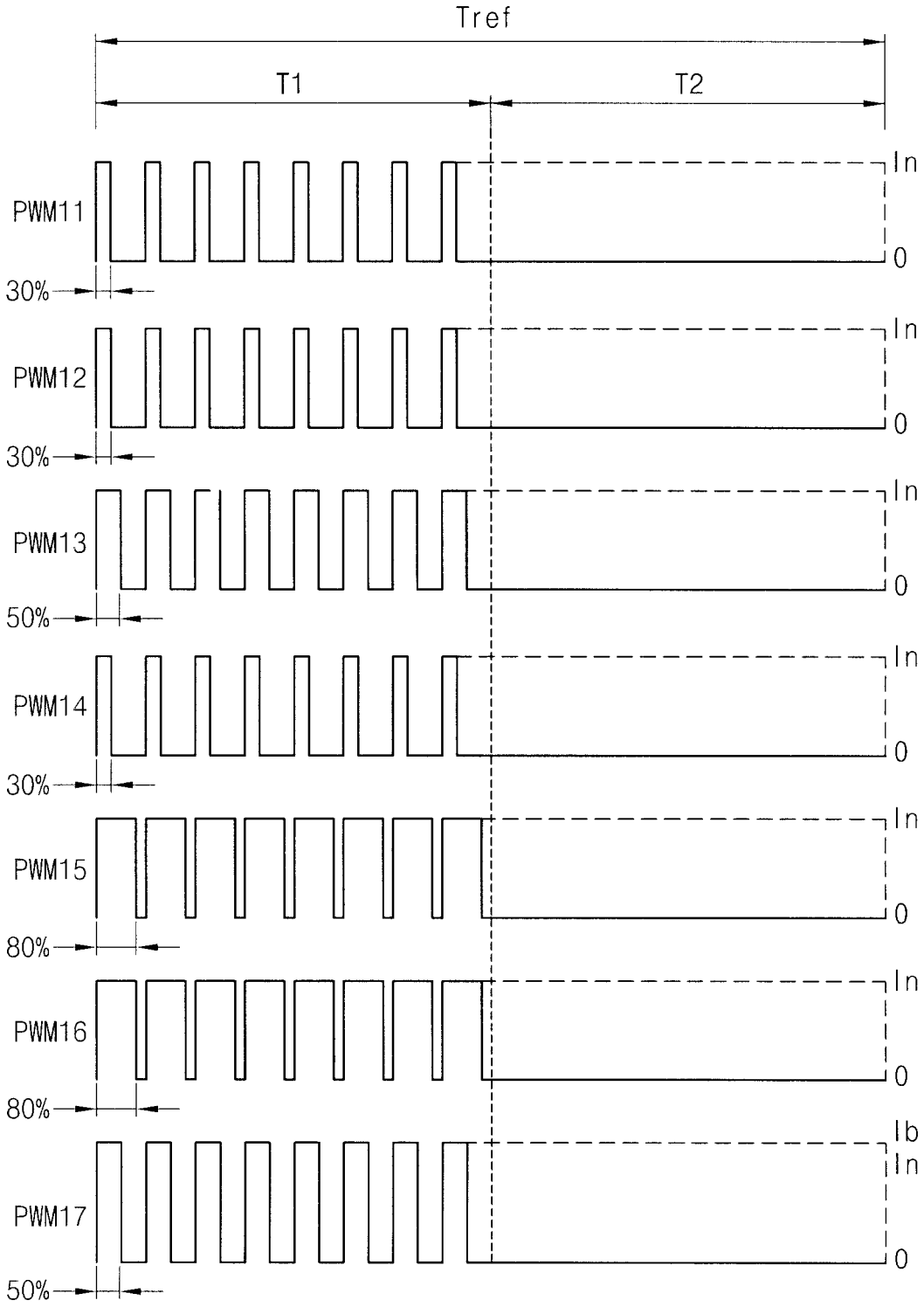
FIGS. 14A and 14B are waveform diagrams of driving signals for displaying the test image of FIG. 13.

The driving chip 731 controls the signal generator 700. For example, in one exemplary embodiment the driving chip 731 generates a first selecting signal SP1 and a second selecting signal SP2. The first and second selecting signals SP1 and SP2 have inversed phases with respect to one another and in the present exemplary embodiment have substantially the same pulse width. As shown in FIG. 14A, the first and second selecting signals SP1 and SP2 have the pulse width corresponding to about ½ of the reference period Tref. The pulse width of the first and second selecting signals SP1 and SP2 according to the present exemplary embodiment is fixed, which is different from the previous exemplary embodiment of FIG. 1.

The driving chip 731 generates a first group of first to k-th driving signals PWM11, PWM12, PWM13, . . . , PWM1*k* based on the first group of the duty ratios. The driving chip 731 generates a second group of first to m-th driving signals PWM21, PWM22, PWM23, . . . , PWM2*m* based on the second group of the duty ratios. For example, in one exemplary embodiment the first and second selecting signals SP1 and SP2 have a frequency of several Hz and the driving signals of the first and second group of the driving signals PWM11, PWM12, PWM13, . . . , PWMk, PWM21, PWM22, PWM23, . . . , PWM2*m* have the frequency of several KHz.

A control electrode of the first time division element TS1 is electrically connected to the driving chip 731. An input electrode of the first time division element TS1 is electrically connected to the booster 710. An output electrode of the first time division element TS1 is commonly electrically connected to first terminals of the first group of the light source blocks B11, B12, B13, . . . , B1*k*. A control electrode of the second time division element TS2 is electrically connected to the driving chip 731. An input electrode of the first time division element TS2 is electrically connected to the booster 710. An output electrode of the first time division element TS2 is commonly electrically connected to first terminals of the second group of the light source blocks B21, B22, B23, . . . , B2*m*.

The first time division element TS1 provides the driving voltage VD to the first group of the light source blocks B11, B12, B13, . . . , B1*k* during the first period corresponding to the first cycle T1 in the reference period Tref in response to the first selecting signal SP1. The second time division element TS2 provides the driving voltage VD to the second group of the light source blocks B21, B22, B23, . . . , B2*m* during the second period corresponding to the second cycle T2 in the reference period Tref in response to the second selecting signal SP2.

For example, in one exemplary embodiment the first time division element TS1 is turned on and applies the driving voltage VD to the first group of the light source blocks B11, B12, B13, . . . , B1*k* during the first period T1, that is an initial half of the reference period Tref, in which the first selecting signal SP1 is at a high level, e.g., in an "on" state. The second time division element TS2 is turned off and blocks the driving voltage VD to the second group of the light source blocks B21, B22, B23, . . . , B2*m* during the first period. The second time division element TS2 is turned on and applies the driving voltage VD to the second group of the light source blocks B21, B22, B23, . . . , B2*m* during the second period T2, that is a last half of the reference period Tref, in which the second selecting signal SP2 is in the high level. The first time division element TS1 is turned off and blocks the driving voltage VD to the second group of the light source blocks B21, B22, B23, . . . , B2*m* during the second period T2.

Each control electrode of the first group of the switching elements SW11, SW12, . . . , SW1*k* is electrically connected to the driving chip 731. Each input electrode of the first group of the switching elements SW11, SW12, . . . , SW1*k* is electrically connected to second terminals of the first group of the light source blocks B11, B12, B13, . . . , B1*k*. Each control electrode of the second group of the switching elements SW21, SW22, . . . , SW2*m* is electrically connected to the driving chip 731. Each input electrode of the second group of the switching elements SW21, SW22, . . . , SW2*m* is electrically connected to second terminals of the second group of the light source blocks B21, B22, B23, . . . , B2*m*.

The first group of the switching elements SW11, SW12, . . . , SW1*k* controls driving of the first group of the light source blocks B11, B12, B13, . . . , B1*k* respectively in response to the first group of the driving signals PWM11, PWM12, PWM13, . . . , PWM1*k*. The second group of the switching elements SW21, SW22, . . . , SW2*m* controls driving of the second group of the light source blocks B21, B22, B23, . . . , B2*m* respectively in response to the second group of the driving signals PWM21, PWM22, PWM23, . . . , PWM2*m*.

Figure 13:
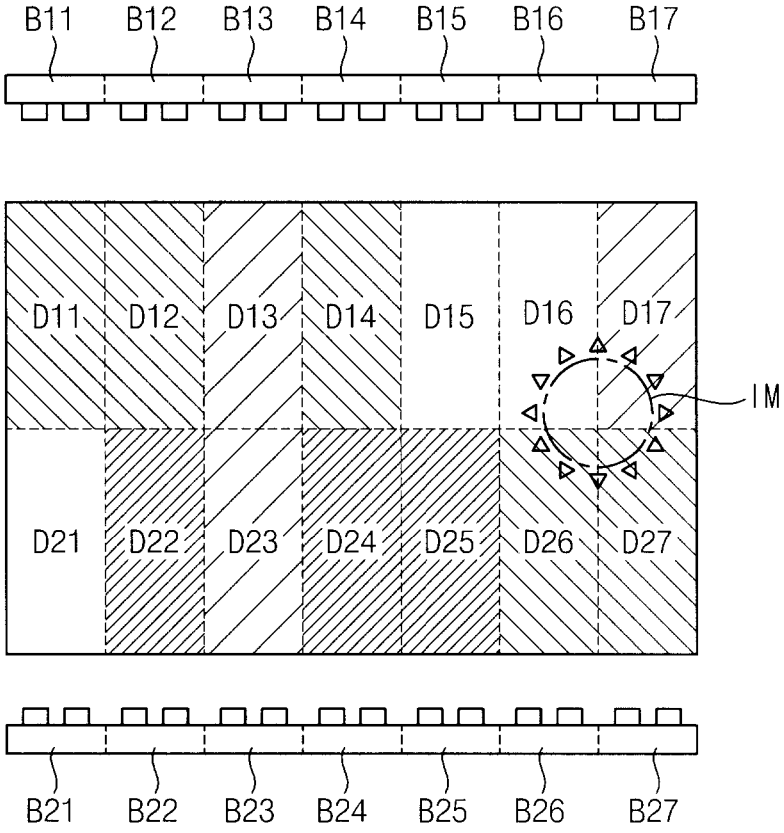
FIG. 13 is a conceptual diagram illustrating a test image displayed on the exemplary embodiment of a display apparatus of FIG. 10.
Figure 14B:
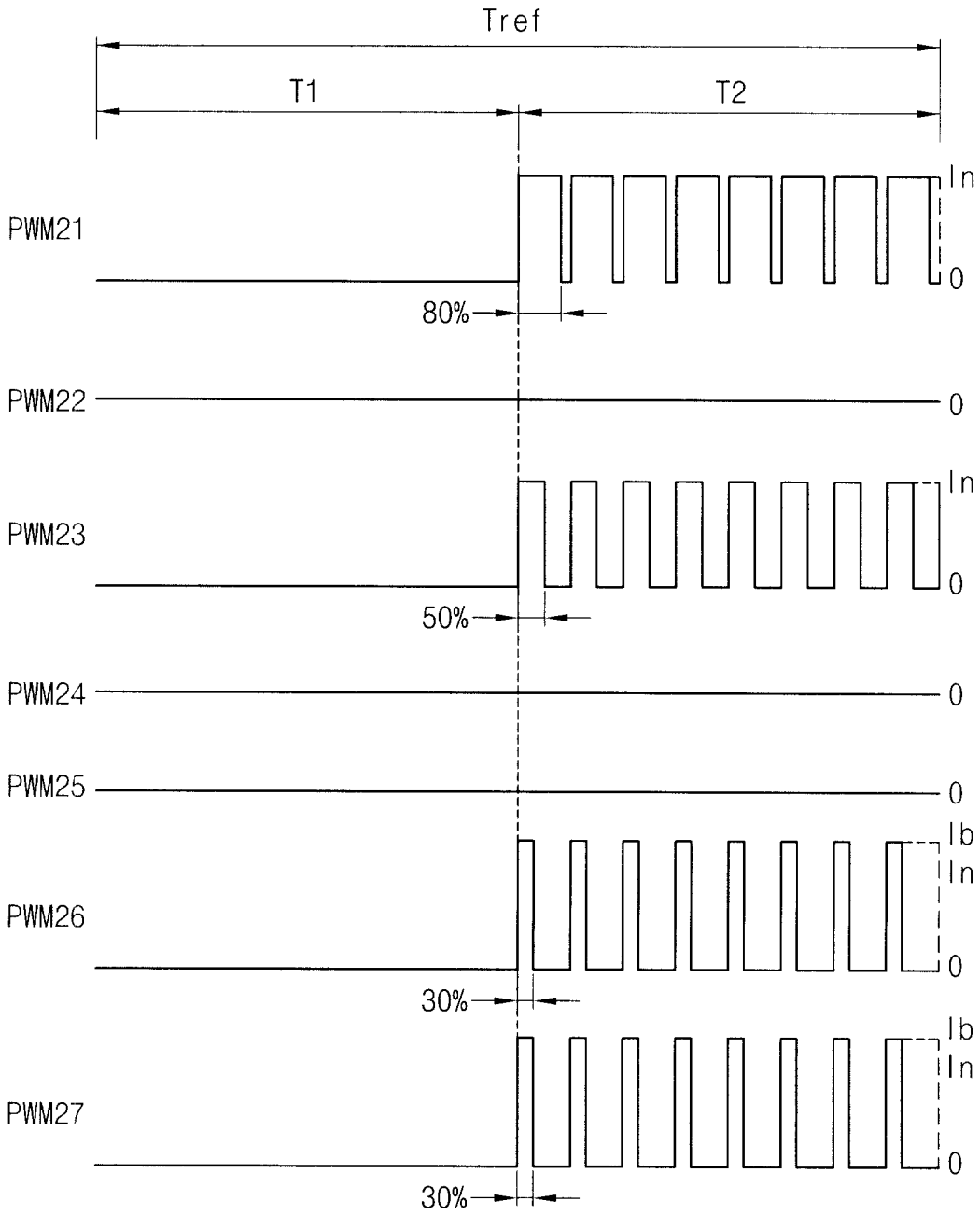

FIG. 13 is a conceptual diagram illustrating an exemplary embodiment of a test image displayed on the display apparatus of FIG. 10. FIGS. 14A and 14B are waveform diagrams of driving signals for displaying the test image of FIG. 13.

Referring to FIGS. 10, 13, 14A and 14B, the dimming level decision part 610 determines the first group of first to k-th duty ratios corresponding to the first group of light source blocks B11, B12, B13, . . . , B1*k* and the second group of first to m-th duty ratios corresponding to the second group of light source blocks B21, B22, B23, . . . , B2*m* based on the representative luminance values of the first and second groups of image blocks D11, D12, D13, . . . , D1*k*, D21, D22, D23, . . . , D2*m*, respectively.

For example, in the present exemplary embodiment the dimming level decision part 610 determines duty ratios of driving signals for the first, second and fourth light source blocks B11, B12 and B14 of the first group to be about 30%. The dimming level decision part 610 determines duty ratios of driving signals for the third and seventh light source blocks B13 and B17 of the first group to be about 50%. The dimming level decision part 610 determines duty ratios of driving signals for the fifth and sixth light source blocks B15 and B16 of the first group to be about 80%. The dimming level decision part 610 determines a duty ratio of a driving signal for the first light source block B21 of the second group to be about 80%. The dimming level decision part 610 determines duty ratios of driving signals for the second, fourth and fifth light source blocks B22, B24 and B25 of the second group to be about 0%. The dimming level decision part 610 determines a duty ratio of a driving signal for the third light source block B23 of the second group to be about 50%. Finally, the dimming level decision part 610 determines duty ratios of driving signals for the sixth and seventh light source blocks B26 and B27 of the second group to be about 30%.

The boosting decision part 630 determines to boost luminance of the seventh light source block B17 of the first group and the sixth and seventh light source blocks B26 and B27 of the second group having relatively lower luminance and smaller duty ratios among the sixth and seventh light source blocks B16, B26, B17 and B27 of the first and second groups providing light to an image IM having a uniform grayscale. Thus the uniform grayscale of the image IM may be clearly displayed over the various display blocks D16, D17, D26 and D27.

Thus, the signal generator 700 generates the first group of driving signals PWM11, PWM12, . . . , PWM17 and provides the first group of driving signals PWM11, PWM12, . . . , PWM17 to the first group of light source blocks B11, B12, . . . , B17, respectively, according to a control signal provided by the dimming level decision part 610 and the boosting decision part 630. The signal generator 700 generates the second group of driving signals PWM21, PWM22, . . . , PWM27 and provides the second group of driving signals PWM21, PWM22, . . . , PWM27 to the second group of light source blocks B21, B22, . . . , B27, respectively according to a control signal provided by the dimming level decision part 610 and the boosting decision part 630. In the current exemplary embodiment, each peak current level of the driving signals provided to the seventh light source block B17 of the first group and the sixth and seventh light source blocks B26 and B27 of the second group has the boosting current level Ib which is higher than the normal current level In.

As shown in FIG. 14A, the first, second and fourth driving signals PWM11, PWM12 and PWM14 corresponding to about 30% duty ratio are provided to the first, second and fourth light source blocks B11, B12 and B14, respectively, of the first group during a first period corresponding to the first cycle T1, which is about 5/10 (or half) of the reference period. The third and seventh driving signals PWM13 and PWM17 corresponding to about 50% duty ratio are provided to the third and seventh light source blocks B13 and B17, respectively, of the first group. The fifth and sixth driving signals PWM15 and PWM16 corresponding to about 80% duty ratio are provided to the fifth and sixth light source blocks B15 and B16, respectively, of the first group. In the current exemplary embodiment, peak current levels of the first to sixth driving signals PWM11, . . . , PWM16 of the first group have normal levels In. Also in the current exemplary embodiment, a peak current level of the seventh driving signal PWM17 of the first group has the boosting level Ib.

Referring to FIG. 14B, the first driving signal PWM21 corresponding to about 80% duty ratio is provided to the first light source block B21 of the second group during a second period corresponding to the second cycle T2, which is about 5/10 (or half) of the reference period Tref. The second, fourth and fifth driving signals PWM22, PWM24 and PWM25 corresponding to about 0% duty ratio are provided to the second, fourth and fifth light source blocks B22, B24 and B25, respectively, of the second group. The third driving signal PWM23 corresponding to about 50% duty ratio is provided to the third light source block B23 of the second group. The sixth and seventh driving signals PWM26 and PWM27 corresponding to about 30% duty ratio are provided to the sixth and seventh light source block B26 and B27, respectively, of the second group. In the current exemplary embodiment, peak current levels of the first and third driving signals PWM21 and PWM23 of the second group have normal levels In. Also in the current exemplary embodiment, peak current levels of the sixth and seventh driving signals PWM26 and PWM27 of the second group have the boosting levels Ib.

Although not shown in the figures, the test image in FIG. 13 may be driven using the motion-adaptive luminance curve illustrated in FIG. 8. For example, in such an exemplary embodiment, the dimming driver 600 may determine a peak current level according to a ratio of an area of a relatively brighter image of a total image. When the motion-adaptive luminance curve is applied, a contrast ratio of the test image increases and efficiency of the power consumption may be improved.

Figure 15:
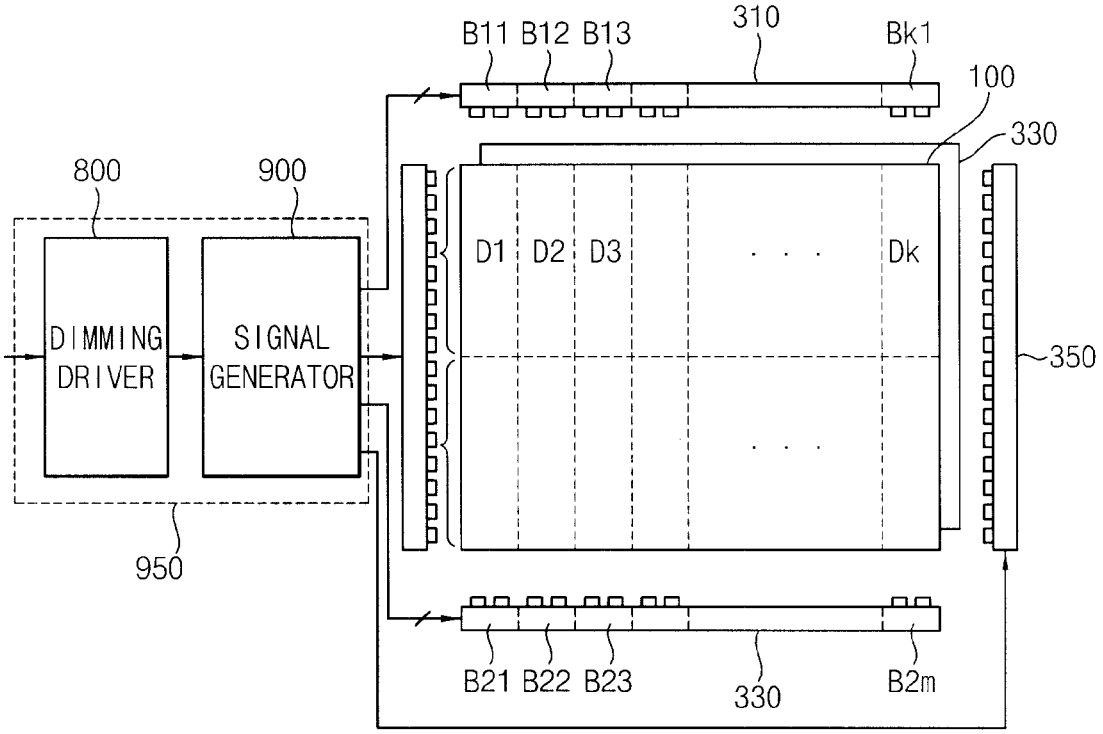
FIG. 15 is a block diagram illustrating another exemplary embodiment of a display apparatus according to the present invention.

FIG. 15 is a block diagram illustrating another exemplary embodiment of a display apparatus according to the present invention.

Referring to FIGS. 2 and 15, the present exemplary embodiment of a display apparatus includes a display panel 110, a light source module (not shown) and a light source driver 950. The display apparatus according to the present exemplary embodiment is substantially the same as the display apparatus in the previous exemplary embodiment of FIG. 1 except for the light source module and the light source driver 950. Thus, the same reference numerals will be used to refer to the same or like parts as those described in the previous exemplary embodiment and any further repetitive explanation will be omitted.

The light source module includes a first light emitting module 310, a second light emitting module 320, a third light emitting module 340, a fourth light emitting module 350 and a light guide plate 330.

The first light emitting module 310 is disposed at a first edge of the light guide plate 330. The second light emitting module 320 is disposed at a second edge of the light guide plate 330 opposite to the first edge. The third light emitting module 340 is disposed at a third edge of the light guide plate 330 adjacent to the first edge. The fourth light emitting modules 350 is disposed at a fourth edge of the light guide plate 330 opposite to the third edge. The light guide plate 330 guides light generated from the first, second, third and fourth light emitting modules to the display panel 110. In the present exemplary embodiment, each of the first to fourth light emitting modules 310, 320, 340 and 350 includes a plurality of LEDs and a printed circuit board on which the LEDs are mounted, although alternative exemplary embodiments may include alternative light emitting devices.

As illustrated in the previous exemplary embodiment of FIG. 1, the first and second light emitting modules 310 and 320 include a plurality of light emitting blocks for dimming driving according to luminance of an image displayed on the display panel 110. For example, in the present exemplary embodiment the first light emitting module 310 includes a first group of light source blocks B11, B12, B13, . . . , B1*k*. The second light emitting module 320 includes a second group of light source blocks B21, B22, B23, . . . , B2*m*.

The third and fourth light emitting modules 340 and 350 provide the light to the display panel 110 to increase luminance of the image displayed on the display panel 110.

As described above, the light source driver 950 includes a dimming driver 800 and a signal generator 900.

The dimming driver 800 includes elements substantially similar to the dimming driver 400 described with respect to previous exemplary embodiments and operates substantially the same as the operation of the dimming driver 400 in the previous exemplary embodiment of FIG. 1. Thus, the dimming driver 800 drives dimming of the first and second light emitting modules 310 and 320. In addition, the dimming driver 800 drives the third and fourth light emitting modules 340 and 350.

As illustrated in the previous exemplary embodiment of FIG. 1, the signal generator 900 divides the reference period into two periods, which include a first period and a second period, based on a luminance ratio between first and second partial images DP1 and DP2. The signal generator 900 provides driving signals to the first and second light emitting modules 310 and 320 according to control signals from the dimming driver 800. In addition, the signal generator 900 provides driving signals to the third and fourth light emitting modules 340 and 350 during the reference period according to the control of the dimming driver 800. For example, in one exemplary embodiment the third and fourth light emitting modules 340 and 350 provide the light having a predetermined luminance value, while the first and second light emitting modules 310 and 320 are driven, so that a luminance shortage caused by dimming driving of the first and second light emitting modules 310 and 320 may be compensated.

As mentioned above, the first and second light emitting modules 310 and 320 are dimming driven, and the third and fourth emitting modules 340 and 350 are driven to improve the luminance of the overall apparatus. Alternative exemplary embodiments include configurations wherein the dimming driving may be performed with respect to the third and fourth light emitting modules 340 and 350, and the first and second emitting modules 310 and 320 may be driven to improve the luminance of the overall apparatus.

As mentioned above, the dimming driving in the previous exemplary embodiment of FIG. 1 is performed with respect to the first and second light emitting modules 310 and 320. Alternative exemplary embodiments include configurations wherein the dimming driving in the previous exemplary embodiment of FIG. 10 may be performed with respect to the first and second light emitting modules 310 and 320 of FIG. 15. For example, according to the previous exemplary embodiment of FIG. 10, the dimming driving may be performed with respect to the first and second light emitting modules 310 and 320 and the third and fourth light emitting modules may be driven to improve the luminance.

Figure 16:
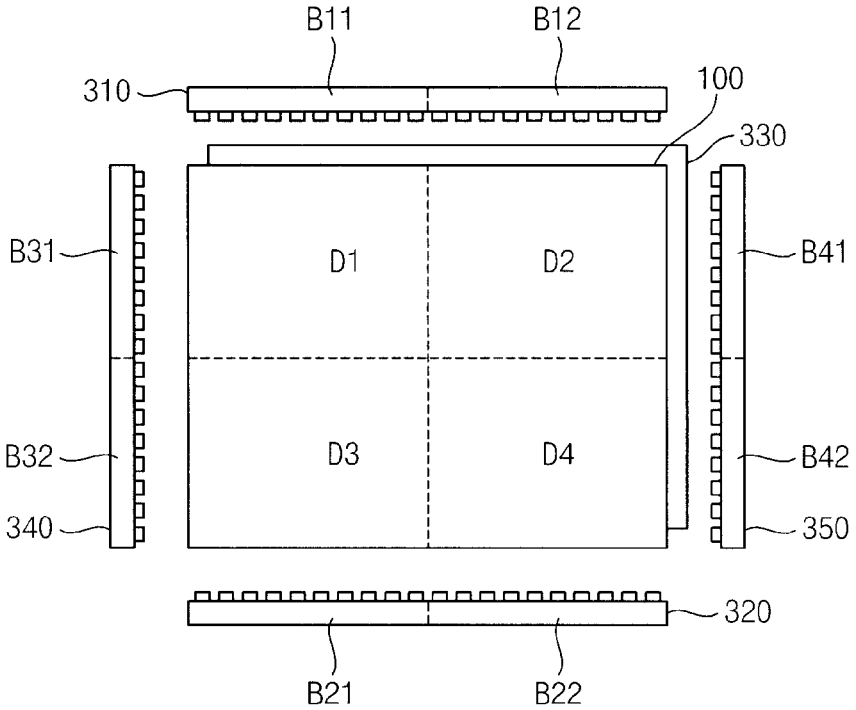
FIG. 16 is a block diagram illustrating another exemplary embodiment of a display apparatus according to the present invention.

FIG. 16 is a block diagram illustrating another exemplary embodiment of a display apparatus according to the present invention.

Referring to FIGS. 2 and 16, the present exemplary embodiment of a display apparatus includes a display panel 110 and a light source module providing light to the display panel 110.

The light source module includes a first light emitting module 310, a second light emitting module 320, a third light emitting module 340, a fourth light emitting module 350 and a light guide plate 330. The first light emitting module 310 is disposed at a first edge of the light guide plate 330. The second light emitting module 320 is disposed at a second edge of the light guide plate 330 opposite to the first edge. The third light emitting module 340 is disposed at a third edge of the light guide plate 330 adjacent to the first edge. The fourth light emitting modules 350 is disposed at a fourth edge of the light guide plate 330 opposite to the third edge. In the present exemplary embodiment, each of the first to fourth light emitting modules 310, 320, 340 and 350 includes a plurality of LEDs and a printed circuit board on which the LEDs are mounted respectively.

The first light emitting module 310 includes a first group of light emitting blocks B11 and B12. The second light emitting module 320 includes a second group of light emitting blocks B21 and B22. The third light emitting module 340 includes a third group of light emitting blocks B31 and B32. The fourth light emitting module 350 includes a fourth group of light emitting blocks B41 and B42.

Luminance of the first, second, third and fourth light emitting modules 310, 320, 340 and 350 is determined corresponding to an image displayed on the display panel 110.

For example, in one exemplary embodiment a frame image is displayed on the display panel 110. The frame image is divided into four image blocks D1, D2, D3 and D4, wherein the image blocks D1-D4 have a 2 by 2 matrix structure, corresponding to the light source blocks of the first, second, third and fourth light emitting modules 310, 320, 340 and 350.

Dimming levels of the first light source block B11 of the first group and the first light source block B31 of the third group are determined according to luminance of the first image block D1. Dimming levels of the second light source block B12 of the first group and the first light source block B41 of the fourth group are determined according to luminance of the second image block D2. Dimming levels of the first light source block B21 of the second group and the second light source block B32 of the third group are determined according to luminance of the third image block D3. Dimming levels of the second light source block B22 of the second group and the second light source block B42 of the fourth group are determined according to luminance of the fourth image block D4.

Thus, when the first and second light emitting modules 310 and 320 include i light source blocks and the third and fourth light emitting modules 340 and 350 include j light source blocks, the light emitting module may drive a two-dimensional dimming driving method using each of i×j light source blocks. In this case, 'i' and 'j' are natural numbers.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method of dimming a light source module, comprising:

generating a first group of first to k-th driving signals and a second group of first to m-th driving signals, based on an image signal;

driving first to k-th light source blocks of a first light emitting module using the first group of first to k-th driving signals during a first period of a reference period, and driving first to m-th light source blocks of a second light emitting module using the second group of first to m-th driving signals during a second period of the reference period; and determining the duration of the first period and the duration of the second period using a luminance ratio between a first partial image displayed on a portion of a display panel adjacent to the first light emitting module and a second partial image, which is different from the first partial image, displayed on a portion of the display panel adjacent to the second light emitting module, wherein the light source module comprises a light guide plate, the first light emitting module disposed at a first edge of the light guide plate, and the second light emitting module disposed at a second edge of the light guide plate being disposed substantially opposite to the first edge of the light guide plate, wherein k and m are natural numbers, and wherein a first selecting signal turns on a first switching element connected to the first light emitting module at the start point of the first period which is the start point of the reference period, and turns off the first switching element before the end point of the first period, and a second selecting signal turns on a second switching element connected to the second light emitting module at the start point of the second period which is the end point of the first period and turns off the second switching element before the end point of the second period which is the end point of the reference period.

2. The method of claim 1, further comprising driving a third light emitting module and a fourth light emitting module during the reference period, wherein the light source module further comprises the third light emitting module disposed at a third edge of the light guide plate being adjacent to the first edge of the light guide plate and the fourth light emitting module disposed at a fourth edge of the light guide plate being substantially opposite to the third edge of the light guide plate.

3. The method of claim 1, further comprising boosting luminance of a light source block having a short driving period among light source blocks corresponding to a predetermined image when the predetermined image having a uniform grayscale is disposed in a boundary area between the first partial image and the second partial image.

4. The method of claim 1, further comprising determining duty ratios of the first group of first to k-th driving signals and the second group of first to m-th driving signals based on the image signal, wherein k is equal to m, wherein the duty ratios of the first group of first to k-th driving signals are substantially the same as the duty ratios of the second group of first to m-th driving signals, respectively.

5. The method of claim 4, further comprising compensating the first period and the second period via a low pass filtering process based on a first period and a second period of a previous frame.

6. The method of claim 4, further comprising compensating each of the duty ratios of the first group of first to k-th driving signals and the duty ratios of the second group of first to m-th driving signals via a low pass filtering process based on a duty ratio of a previous frame; and compensating each of the duty ratios of the first group of first to k-th driving signals and the duty ratios of the second group of first to m-th driving signals via a low pass filtering process based on a duty ratio of an adjacent light source block.

7. The method of claim 1, wherein the first period and the second period are substantially the same length as each other.

8. The method of claim 7, further comprising determining a first group of duty ratios respectively corresponding to the first group of first to k-th driving signals and a second group of duty ratios respectively corresponding to the second group of first to m-th driving signals, based on the image signal.

9. The method of claim 8, further comprising boosting luminance of a light source block having a lesser duty ratio among light source blocks corresponding to a predetermined image when the predetermined image having a substantially uniform grayscale is disposed on a portion of a display panel corresponding to adjacent light source blocks.

10. The method of claim 8, further comprising:

compensating each of the first group of duty ratios and the second group of duty ratios, based on a duty ratio of a previous frame via a low pass filtering process; and compensating each of the first group of duty ratios and the second group of duty ratios, based on a duty ratio of an adjacent light source block via the low pass filtering process.

11. A display apparatus comprising:

a display panel;

a light source module comprising a first light emitting module including first to k-th light source blocks and disposed at a first edge of the display panel, and a second light emitting module including first to m-th light source blocks and disposed at a second edge of the display panel, the second edge being disposed substantially opposite to the first edge;

a first switching element connected to the first light emitting module;

a second switching element connected to the second light emitting module; and a light source driver which generates a first group of first to k-th driving signals to drive the first to k-th light source blocks of the first light emitting module during a first period of a reference period, and which generates a second group of first to m-th driving signals to drive the first to m-th light source blocks of the second light emitting module during a second period of the reference period, wherein k and m are natural numbers, wherein the light source driver comprises a cycle decision part which determines the duration of the first period and the duration of the second period using a luminance ratio between a first partial image displayed on a portion of the display panel adjacent to the first light emitting module and a second partial image, which is different from the first partial image, displayed on a portion of the display panel adjacent to the second light emitting module, and wherein a first selecting signal turns on the first switching element at the start point of the first period which is the start point of the reference period, and turns off the first switching element before the end point of the first period, and a second selecting signal turns on the second switching element at the start point of the second period which is the end point of the first period and turns off the second switching element before the end point of the second period which is the end point of the reference period.

12. The display apparatus of claim 11, wherein the light source module further comprises a third light emitting module disposed at a third edge of the display panel adjacent to the first edge and a fourth light emitting module disposed at a fourth edge of the display panel opposite to the third edge, and the light source driver drives the third light emitting module and the fourth light emitting module during the reference period.

13. The display apparatus of claim 11, wherein the light source driver further comprises:

a dimming level decision part which determines first to k-th duty ratios using first to k-th image blocks displayed on the display panel; and a signal generator which generates the first group of first to k-th driving signals and the second group of first to m-th driving signals using the first to k-th duty ratios, the first period and the second period.

14. The display apparatus of claim 13, wherein the light source driver further comprises:

a time low pass filter which compensates the first period and the second period based on a first period and a second period of a previous frame via a low pass filtering process, and which compensates each of the first to k-th duty ratios based on a duty ratio of the previous frame via the low pass filtering process; and a spatial low pass filter which compensates each of the first to k-th duty ratios based on a duty ratio of an adjacent light source block via the low pass filtering process.

15. The display apparatus of claim 13, wherein the light source driver boosts luminance of a light source block having a short driving period among light source blocks corresponding to a predetermined image when the predetermined image having a uniform grayscale is disposed in a boundary area between the first partial image and the second partial image.

16. The display apparatus of claim 11, wherein the first period and the second period are substantially the same length.

17. The display apparatus of claim 16, wherein the light source driver comprises:

a dimming level decision part which determines a first group of duty ratios corresponding to the first to k-th light source blocks of the first light emitting module and a second group of duty ratios corresponding to the first to m-th light source blocks of the second light emitting module, based on the image signal; and a signal generator which generates the first group of first to k-th driving signals based on the first group of duty ratios, and the second group of first to m-th driving signals based on the second group of duty ratios.

18. The display apparatus of claim 17, wherein the light source driver further comprises a boosting decision part which boosts luminance of a light source block having a small duty ratio among the light source blocks corresponding to a predetermined image when the predetermined image having a uniform grayscale is disposed on adjacent light emitting blocks.

19. The display apparatus of claim 17, wherein the light source driver further comprises:

a time low pass filter which compensates each of the first group of duty ratios and the second group of duty ratios based on the duty ratio of a previous frame via a low pass filtering process; and a spatial low pass filter which compensates each of the first group of duty ratios and the second group of duty ratios based on a duty ratio of an adjacent light source block via the low pass filtering process.

* * * * *